US007431389B2

(12) United States Patent
Reeb et al.

(10) Patent No.: US 7,431,389 B2
(45) Date of Patent: Oct. 7, 2008

(54) CANOPY CHAIR

(75) Inventors: David Reeb, Columbia, MD (US); Paul Robinette, Canal Winchester, OH (US)

(73) Assignee: Swimways Corporation, Virginia Beach, VA (US)

( * ) Notice: Subject to any disclaimer, the term of this patent is extended or adjusted under 35 U.S.C. 154(b) by 0 days.

(21) Appl. No.: 11/486,176

(22) Filed: Jul. 12, 2006

(65) Prior Publication Data

US 2007/0040422 A1 Feb. 22, 2007

Related U.S. Application Data

(60) Provisional application No. 60/701,905, filed on Jul. 22, 2005.

(51) Int. Cl.
*A47C 7/66* (2006.01)
*A47C 4/00* (2006.01)
*A47C 4/28* (2006.01)

(52) U.S. Cl. ..... 297/184.15; 297/184.1; 297/184.11; 297/17; 135/95; 135/96

(58) Field of Classification Search ..... 297/184.1, 297/184.11, 184.15, 17; 135/95, 96, 115, 135/150
See application file for complete search history.

(56) References Cited

U.S. PATENT DOCUMENTS 900,572 A * 10/1908 Morton ..... 297/184.15
1,256,902 A * 2/1918 Howe ..... 297/184.11 X
1,429,043 A * 9/1922 Martin ..... 297/184.11 X
1,443,921 A * 1/1923 Mackenzie ..... 297/184.11 X
1,605,679 A 11/1926 McGrail
1,639,074 A * 8/1927 Blackwood ..... 297/184.11 X
1,763,455 A * 6/1930 De Bruijn ..... 297/184.11 X
1,789,090 A * 1/1931 Wawrunek ..... 297/184.11 X
2,137,427 A * 11/1938 Thomson ..... 135/96 X
2,166,832 A 7/1939 Wenker
2,243,984 A 6/1941 Singewald
2,429,763 A * 10/1947 Lindabury ..... 297/17 X
2,545,968 A * 3/1951 Newstead ..... 297/184.11 X
2,658,562 A * 11/1953 Androsiglio ..... 297/184.11 X
2,747,653 A * 5/1956 Obradovich ..... 297/184.11 X
2,926,724 A * 3/1960 Rittenberg ..... 297/184.11 X
3,034,523 A * 5/1962 De Shano ..... 297/17
3,243,230 A * 3/1966 Otto ..... 297/184.15
3,404,915 A * 10/1968 De Souza ..... 297/184.1 X (Continued)

FOREIGN PATENT DOCUMENTS

AU 15170/92 A 12/1993

(Continued)

OTHER PUBLICATIONS

Mac Sports Product Sales Sheet, "Shade And Go", undated.

(Continued)

*Primary Examiner*—Rodney B. White

(57) ABSTRACT

An exemplary embodiment providing one or more improvements includes a frame which attaches to outdoor furniture, in particular to a chair, and a canopy. Embodiments can be moved from an overhead position to a behind the chair position. The frames can be moved form a collapsed to a fully extended position. In embodiments the canopy can be positioned to contain the collapsed frame and chair in the carrying position.

28 Claims, 21 Drawing Sheets

U.S. PATENT DOCUMENTS

| | | | | | |
|---|---|---|---|---|---|
| 3,879,086 | A | | 4/1975 | Moceri | |
| 4,030,748 | A | | 6/1977 | Brock | |
| 4,063,318 | A | * | 12/1977 | Nicholson | 135/96 X |
| 4,082,102 | A | * | 4/1978 | Heuer | 135/95 |
| 4,201,416 | A | * | 5/1980 | Vanderminden | 297/184.15 |
| 4,295,481 | A | | 10/1981 | Gee | |
| 4,635,667 | A | | 1/1987 | Harn | |
| 4,687,249 | A | | 8/1987 | Mills | |
| 4,796,734 | A | * | 1/1989 | Distasio | 135/95 X |
| 4,865,381 | A | * | 9/1989 | Van Rogue | 297/184.15 |
| 4,924,896 | A | | 5/1990 | Carter | |
| 4,971,089 | A | * | 11/1990 | Braman | 135/96 X |
| 5,000,210 | A | * | 3/1991 | Worthington, Jr. | 297/184.15 X |
| 5,022,420 | A | * | 6/1991 | Brim | 297/184.1 X |
| 5,080,432 | A | * | 1/1992 | Connell | 297/184.15 |
| 5,096,257 | A | | 3/1992 | Clark | |
| 5,154,473 | A | * | 10/1992 | Joranco | 297/184.15 |
| 5,203,363 | A | * | 4/1993 | Kidwell et al. | 297/184.15 X |
| 5,205,308 | A | * | 4/1993 | Kendall et al. | 297/184.15 X |
| 5,240,020 | A | * | 8/1993 | Byers | 297/184.15 X |
| 5,320,405 | A | | 6/1994 | Foster et al. | |
| 5,441,067 | A | * | 8/1995 | James et al. | 297/184.15 X |
| 5,449,014 | A | * | 9/1995 | Yan-ho | 135/95 |
| 5,551,110 | A | * | 9/1996 | Armstrong et al. | 297/184.15 X |
| 5,579,797 | A | * | 12/1996 | Rogers | 135/96 X |
| 5,582,458 | A | * | 12/1996 | Wildt | 297/184.15 |
| 5,593,205 | A | * | 1/1997 | Vanderminden et al. | 297/184.15 |
| 5,695,100 | A | * | 12/1997 | O'Brien | 135/96 X |
| 5,797,650 | A | * | 8/1998 | Gonzalez et al. | 297/184.1 |
| 5,833,310 | A | * | 11/1998 | Labelle | 297/184.1 |
| 5,873,625 | A | | 2/1999 | Uchtman | |
| 5,921,258 | A | * | 7/1999 | Francois | 297/184.11 X |
| 5,967,601 | A | * | 10/1999 | Gillins | 297/184.15 |
| 6,095,172 | A | * | 8/2000 | Trapp et al. | 297/184.11 X |
| 6,152,156 | A | | 11/2000 | Tung | |
| 6,354,044 | B1 | * | 3/2002 | Lagace, Jr. | 297/184.15 X |
| 6,371,553 | B1 | * | 4/2002 | Tang | 297/184.1 |
| 6,405,742 | B1 | * | 6/2002 | Driscoll | 135/96 |
| 6,655,736 | B1 | * | 12/2003 | Arenas | 297/184.11 X |
| D487,297 | S | * | 3/2004 | Tyler et al. | D21/837 |
| 6,789,557 | B1 | * | 9/2004 | Wahl, Jr. | 135/154 |
| 6,823,883 | B1 | * | 11/2004 | Sears | 135/115 X |
| 6,845,780 | B2 | * | 1/2005 | Bishirjian | 135/96 |
| 6,979,056 | B1 | * | 12/2005 | Goldszer | 297/184.15 |
| 7,048,333 | B2 | * | 5/2006 | Martinez | 297/184.11 |
| 7,198,324 | B2 | * | 4/2007 | Le Gette et al. | 297/184.1 X |
| 7,243,990 | B1 | * | 7/2007 | Wahl | 297/184.15 |
| 7,302,957 | B2 | * | 12/2007 | Ross | 297/184.15 X |
| 7,311,355 | B2 | * | 12/2007 | Fargason, III | 297/184.15 |
| 7,316,450 | B2 | * | 1/2008 | Ayers et al. | 297/184.15 |
| 2002/0112752 | A1 | * | 8/2002 | Blakney | 135/96 |
| 2004/0178665 | A1 | * | 9/2004 | May | 297/16.1 |
| 2004/0222678 | A1 | * | 11/2004 | Hansen | 297/184.1 |
| 2006/0054207 | A1 | * | 3/2006 | Wootliff | 297/184.1 X |
| 2007/0018486 | A1 | * | 1/2007 | Ayers et al. | 297/184.15 |
| 2007/0145792 | A1 | * | 6/2007 | Miller | 297/184.1 |
| 2007/0181172 | A1 | * | 8/2007 | Harrison | 135/96 X |

FOREIGN PATENT DOCUMENTS

| | | | |
|---|---|---|---|
| DE | 26 55 028 | A1 | 6/1978 |
| DE | 31 31 166 | A1 | 2/1983 |
| DE | 42 01 743 | A1 | 10/1992 |
| GB | 2 091 648 | A | 8/1982 |
| WO | WO 82/01984 | A1 | 6/1982 |
| WO | WO 91/14386 | A1 | 10/1991 |
| WO | WO 96/39066 | A1 | 12/1996 |

OTHER PUBLICATIONS

Mac Sports Commercial Invoice, dated Jul. 7, 2004.
Mac Sports Product Photographs, undated, 13 pages.
International Preliminary Report on Patentability, dated Jan. 22, 2008, 6 pages.
International Search Report and Written Opinion of the International Searching Authority for PCT Application No. PCT/US06/26993, mailed Sep. 25, 2007, 8 pages.

* cited by examiner

CANOPY CHAIR

CROSS-REFERENCE(S)

This application claims priority from provisional patent application Ser. No. 60/701,905, filed Jul. 22, 2005.

STATEMENT REGARDING FEDERALLY SPONSORED RESEARCH OR DEVELOPMENT

Not Applicable.

REFERENCE TO A "MICROFICHE APPENDIX"

Not Applicable.

BACKGROUND

Description of Related Art Icluding Information Disclosed Under 37 CFR 1.97 AND 37 CFR 1.98

U.S. Pat. No. 4,295,481 discloses an adjustable sunshade with a fabric covered canopy constructed out of a plastic such a polypropylene or out of metal such as aluminum or out of wood.

U.S. Pat. No. 4,635,667 discloses a canopy which is slid ably attached to the back of a chair and which may be adjusted using a tension cap.

U.S. Pat. No. 4,687,249 discloses an adjustable canopy for a beach chair in which the fabric canopy is attached to a frame by side members which project from tubular side members on the back of the chair.

U.S. Pat. No. 4,924,896 discloses a fabric covered collapsible canopy which is attached to a chair by attachment means. The canopy includes a cross-coupled truss structure support which collapses for storage.

U.S. Pat. No. 4,971,089 discloses a folding shelter with a canopy which attaches to a folding chair. The fabric canopy is supported by upper and lower struts which are attached to real rails at the back of the chair. The canopy can be collapsed and stored in a carrying case somewhat longer than a golf bag.

U.S. Pat. No. 5,096,257 discloses a sunshade for a chair having a rigid visor. The sunshade has a fabric cover which is supported by a U-shaped structure comprised of horizontal support arms and a tubular cross arm. Vertical shade support arms are attached to the back of the chair by clamps.

U.S. Pat. No. 5,873,625 discloses a folding chair with canopy in which the canopy is supported by spacer members which also form the back of the chair and by support members which are pivotally attached to the arm rests.

U.S. Pat. No. 6,789,557 discloses a sunshade which is foldable and may be attached to a chair via a novel attachment means which resembles a clamp.

The foregoing examples of the related art and limitations related therewith are intended to be illustrative and not exclusive. Other limitations of the related art will become apparent to those of skill in the art upon a reading of the specification and a study of the drawings.

BRIEF SUMMARY

The following embodiments and aspects thereof are described and illustrated in conjunction with systems, tool and methods which are meant to be exemplary and illustrative, not limiting in scope. In various embodiments, one or more of the above-described problems have been reduced or eliminated, while other embodiments are directed to other improvements.

Embodiments include frames and canopies for outdoor furniture in which a frame or frames support the canopy, the frame capable of orientation in an overhead position and a behind the furniture position, and in any position intermediate between the overhead and behind the furniture positions.

In addition to the exemplary aspects and embodiments described above, further aspects and embodiments will become apparent by reference to the drawings and by study of the following descriptions.

DETAILED DESCRIPTION

Figure 1:
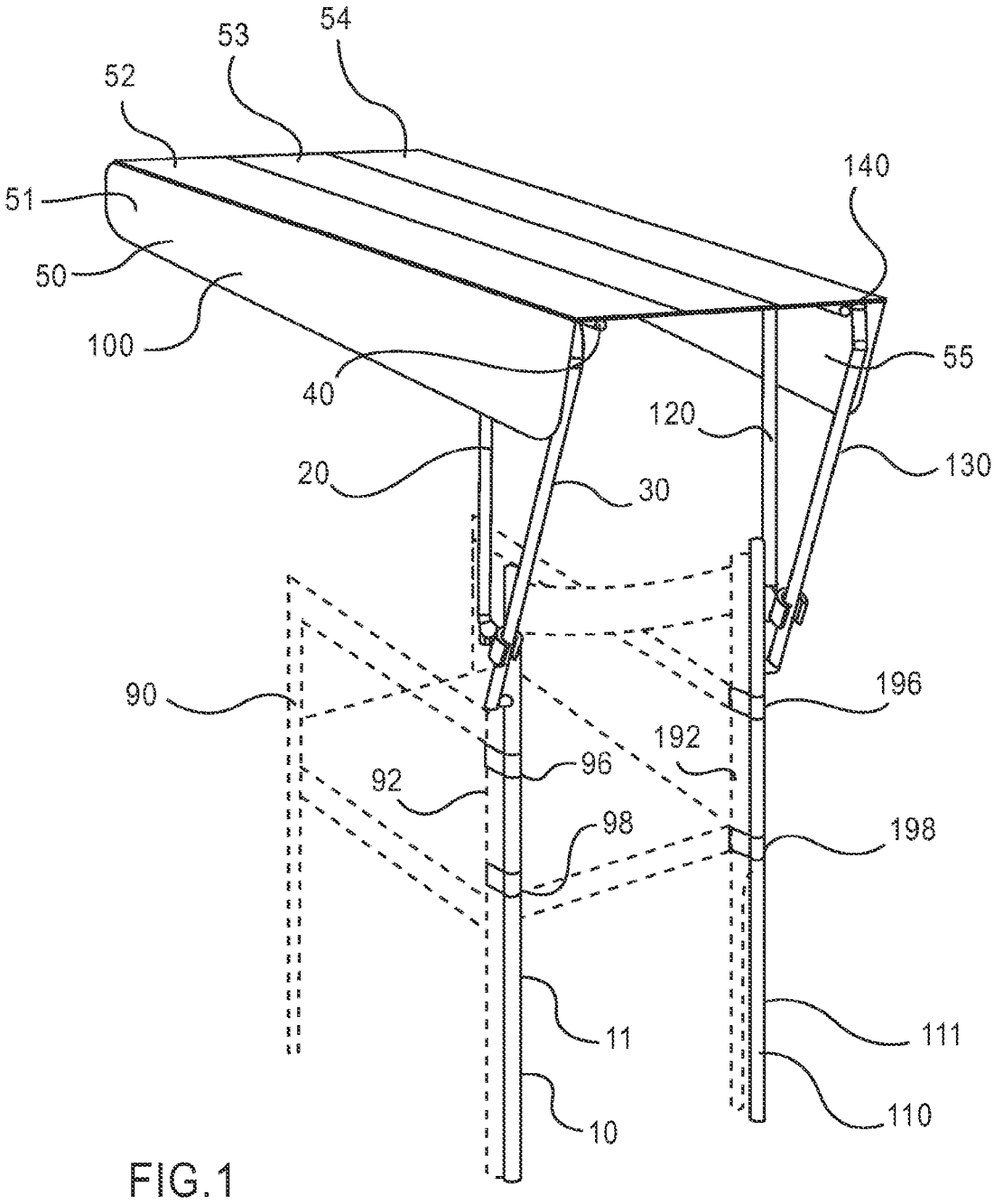
FIG. 1 is a perspective view of an embodiment canopy attached to a chair in the overhead position.

FIG. 1 is a perspective view of an embodiment canopy attached to a chair in the overhead position. Any suitable conventional folding chair may be used in this embodiment. The chair 90 is depicted in dashed lines in FIG. 1. The left vertical chair back 92 and right vertical chair back 192 are depicted. The embodiment canopy 100 shown in FIG. 1 is comprised of a canopy 50 which is supported by a left frame 10 and by a right frame 10. The left vertical support 11 element of the left frame 10 is attached by upper 96 and lower 98 connectors to the left vertical chair back 92. The right vertical support 110 element of the right frame 110 is attached by upper 196 and lower 198 connectors to the left vertical chair back 92. Other components of the left frame 10 visible in FIG. 1 are the left forward bar 20, left rear bar 30, and the left support arm 40, which supports the canopy 50. Other components of the right frame 110 visible in FIG. 1 are the right forward bar 120, right rear bar 130, and the right support arm 140, which supports the canopy 50. Elements of the canopy 50 which are visible in FIG. 1 include the first canopy segment 51, second canopy segment 52, third canopy segment 53, fourth canopy segment 54, and fifth canopy segment 55. The first and fifth canopy segments are termed external segments, and the second, third, and fourth canopy segments are termed internal segments. The external segments are approximately perpendicular to the plane of the internal segments when the canopy is in the overhead position. The canopy segments are hinged together on the long sides of the segments and are shown in additional detail in FIGS. 6 and 7. External segments are hinged on only one side and the internal segments are hinged on each long side. The canopy 50 is attached by connectors to left support bar 40 at the hinge between segments 51 and 52 and to right support bar 140 at the hinge between segments 54 and 55.

Figure 2:
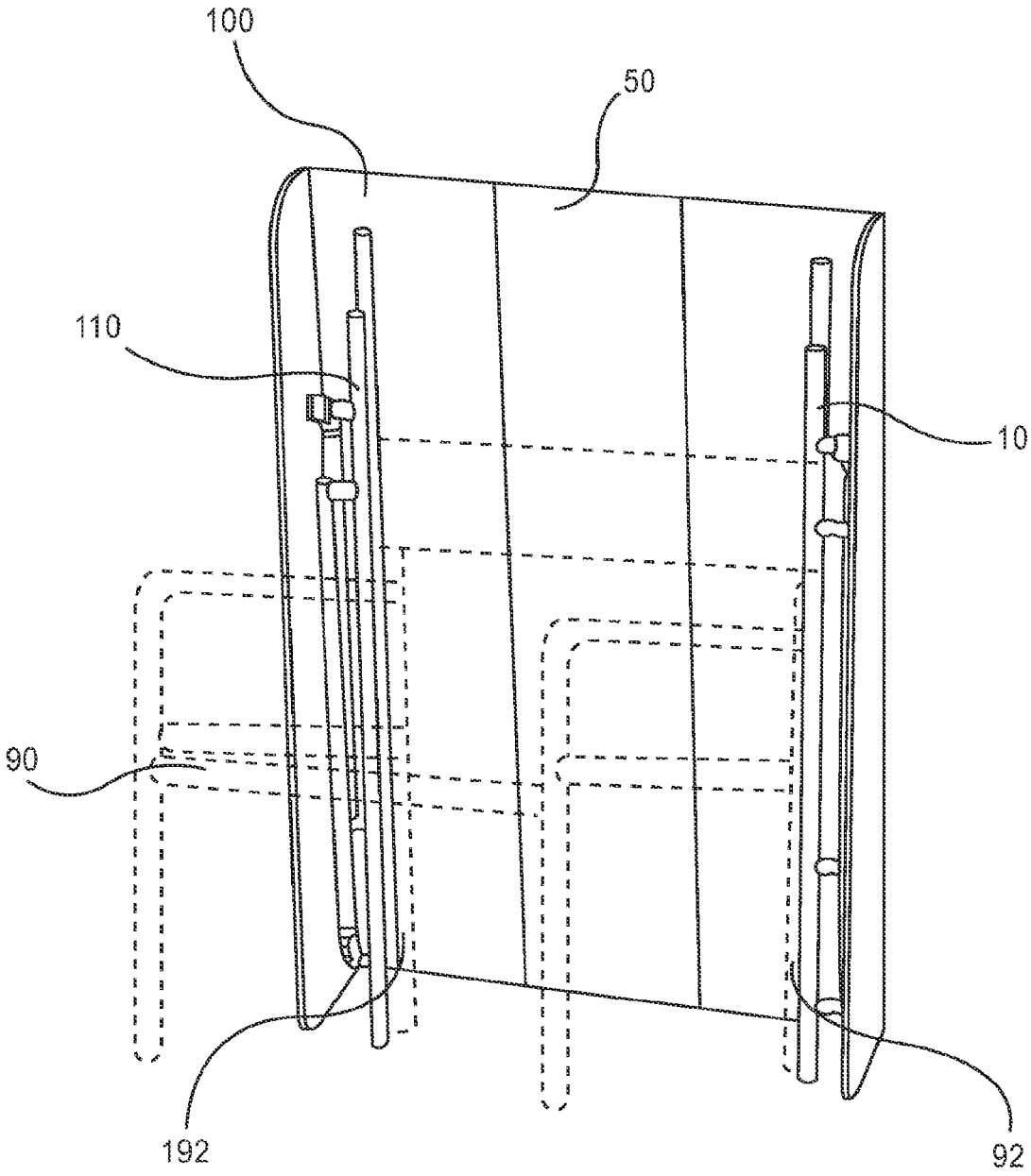
FIG. 2 is a perspective view of an embodiment canopy attached to a chair in the behind the chair position.

FIG. 2 is a perspective view of an embodiment canopy attached to a chair in the behind the chair position. The chair 90 is depicted in dashed lines in FIG. 1. In this position the left frame 10 and right frame 110 are attached to the left vertical back 92 and right vertical back 192 of the chair, respectively. In this embodiment the left frame 10 and right frame 110 are in the collapsed position with the vertical supports, forward bars, rear bars, and support arms roughly parallel. A left frame in the collapsed position is shown in more detail in FIG. 3A.

Figure 3C:
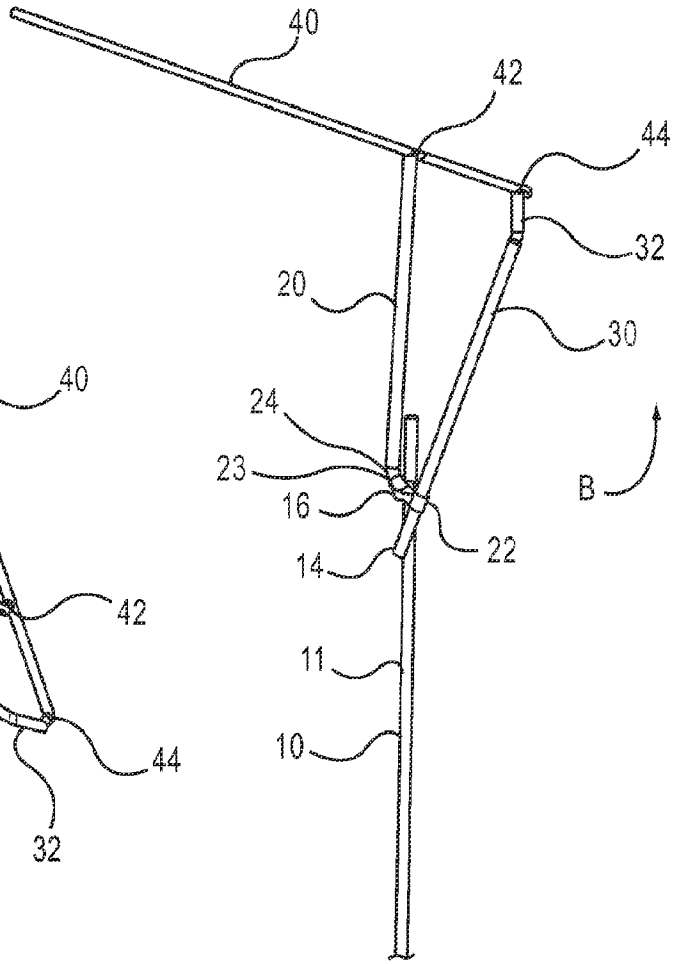
FIG. 3C is a side view of an embodiment left frame in the fully extended position.
Figure 3B:
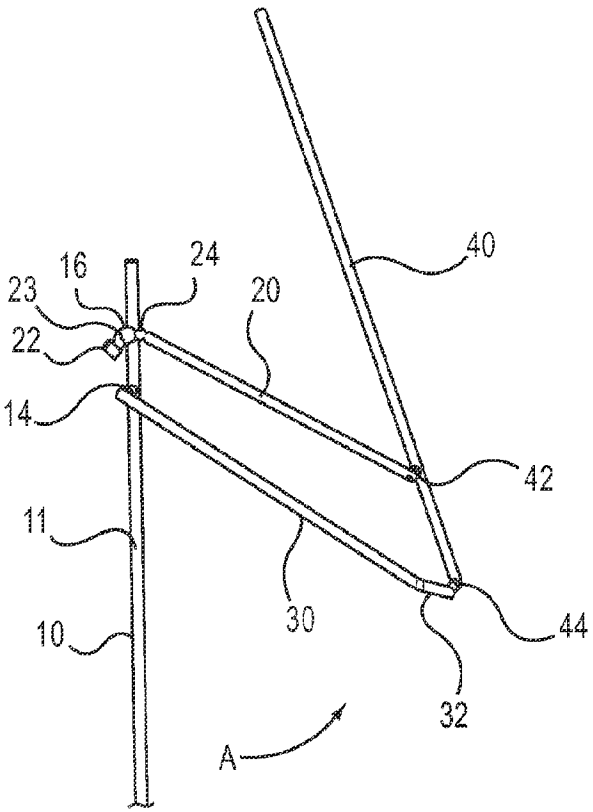
FIG. 3B is a side view of an embodiment left frame in the partially extended position.
Figure 3A:
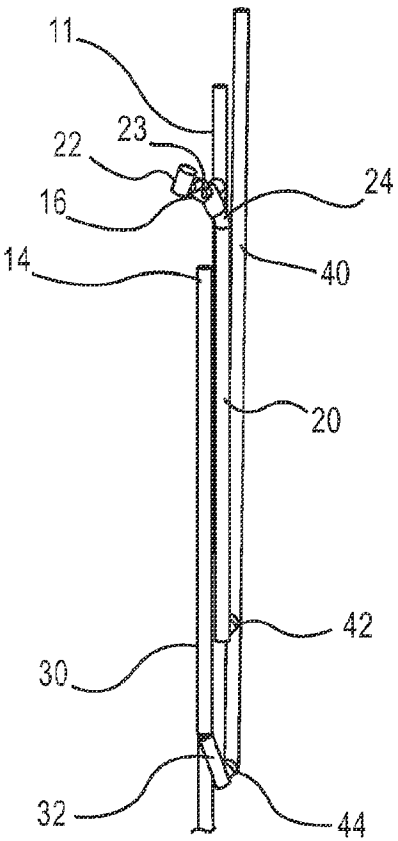
FIG. 3A is a side view of an embodiment left frame in the collapsed position.

FIG. 3A is a side view of an embodiment left frame 10 in the collapsed position. Visible in FIG. 3A is the left vertical support 11, left rear bar 30, left forward bar 20, and left support arm 40. The left vertical support 11 is pivotally attached by a pivot 16 in pivot member 23 to the offset portion 24 of the left forward bar 20 which in turn is attached by pivot 42 to the left support arm 40. A clamp 22 which is attached to the pivot member 23 is not used when the left frame is in the collapsed position. The left support arm 40 is attached by a pivot 44 at one end to an offset portion 32 at one end of the left rear bar 30. The other end of the left rear bar 30 is attached by pivot 14 to the left vertical support 11.

FIG. 3B is a side view of an embodiment left frame in the partially extended position. FIG. 3B shows the same elements as in FIG. 3A. The partially extended position is reached by swinging the left support arm 40 away from the left vertical support 11 in the direction indicated by arrow A. This movement results in extension of the left forward bar 20 and left rear bar 30.

FIG. 3C is a side view of an embodiment left frame in the fully extended position. FIG. 3C shows the same elements as in FIG. 3A. The fully extended position is reached by swinging the left support arm 40 in the direction indicated by arrow B until the left forward bar 20 is approximately parallel with the left vertical support 11, the left rear bar 30 forms an obtuse angle with the left vertical support 11, and the left support arm 40 approaches a perpendicular relationship with the left vertical support 11. The frame is locked in the fully extended position by closing clamp 22 over the left rear arm 30.

A frame is returned to the collapsed position by reversal of the process depicted in FIGS. 3A, 3B, and 3C. Clamp 22 is detached from left rear arm 30, and the left rear bar 30, left forward bar 20, and left support arm 40 are moved in the opposite direction as shown in arrows A and B.

Figure 4:
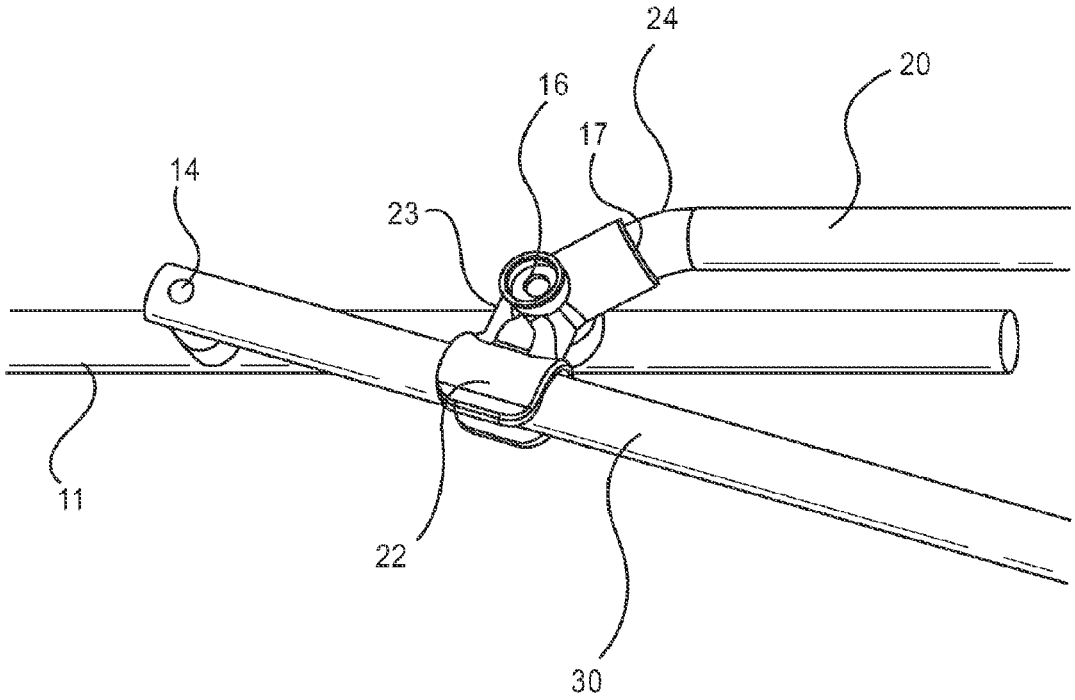
FIG. 4 is a side view of an embodiment of connections between the left vertical support, left forward bar, and left rear bar.

FIG. 4 is a side view of an embodiment of the connections between the left vertical support, left forward bar, and left rear bar and the pivot member when the frame is in the fully extended position. Visible in FIG. 4 is the left vertical support 11 with a pivot 14 connection at one end of the left rear bar 30. The left pivot member 23 is shown connected by a socket 17 at one end of the left pivot member 23 which receives the end of the offset 24 in the left forward bar 20. The offset 24 is a bend of about 15 degrees in the left forward bar 20. The left pivot member 23 is connected by a pivot 16 to the left vertical support 11. Clamp 22 on the other end of the left pivot member 23 is clamped about the left rear bar 30 in the fully extended position. Clamp 22 is sufficiently flexible to allow the user to engage and disengage left rear bar 30 by pressing on the frame.

Although the elements depicted in FIGS. 3A, 3B, 3C and 4 are those of the left frame, identical elements are found in the right frame.

Figure 5:
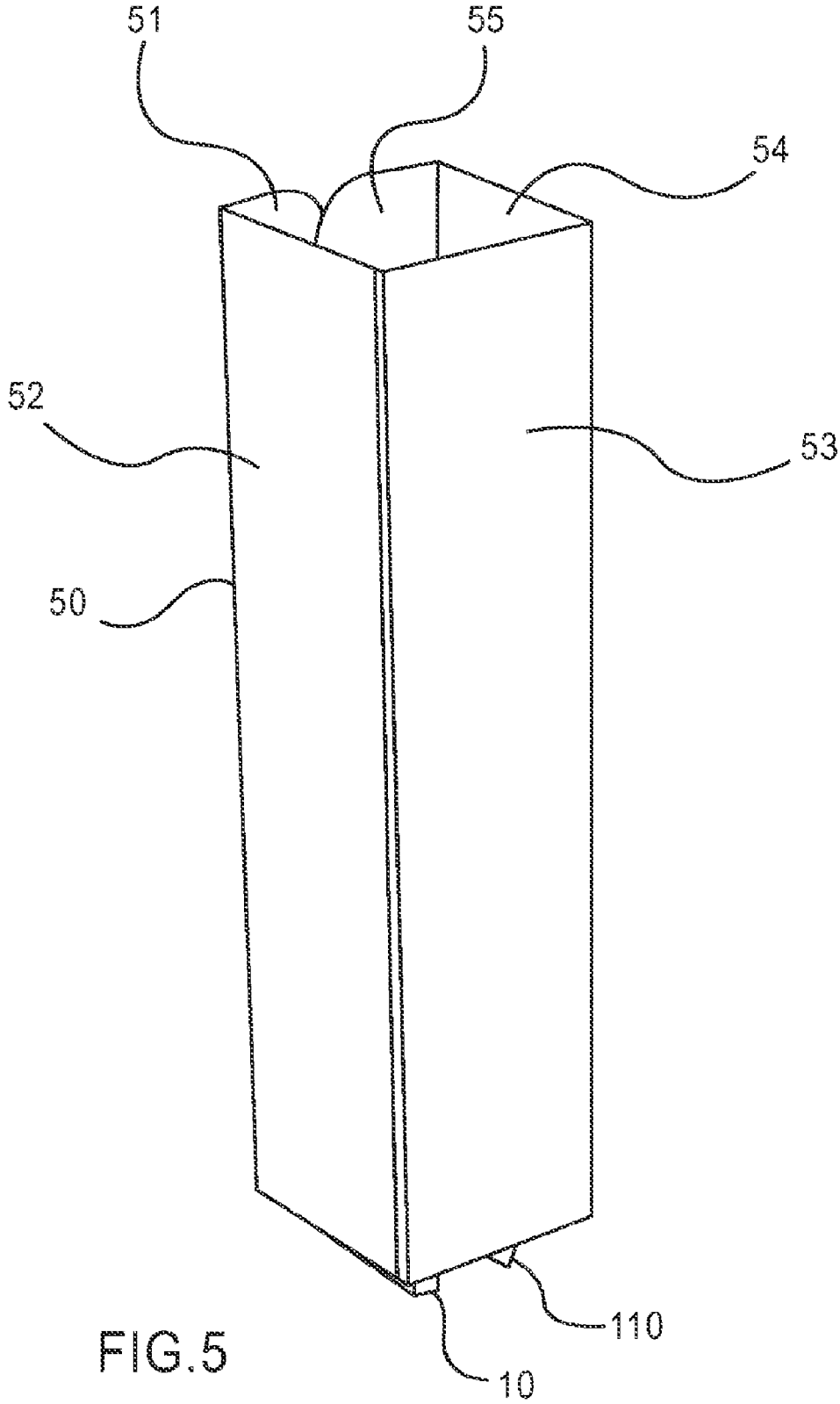
FIG. 5 is a perspective view an embodiment of a canopy in the carrying position.

FIG. 5 is a perspective view an embodiment of a canopy 50 in the carrying position. Visible in FIG. 5 are the $1^{st}$ canopy segment 51, $2^{nd}$ canopy segment 52, $3^{rd}$ canopy segment 53, $4^{th}$ canopy segment 54, and $5^{th}$ canopy segment 55. The $1^{st}$ and $5^{th}$ segments are termed external segments and the $2^{nd}$, $3^{rd}$, and $4^{th}$ segments are termed internal segments. When folded in the carrying position the $1^{st}$ canopy segment 51 and $5^{th}$ canopy segments 55 overlap. The left frame 10 and right frame 110 are in the collapsed position and are enclosed by the canopy segments when in the carrying position.

Figure 6:
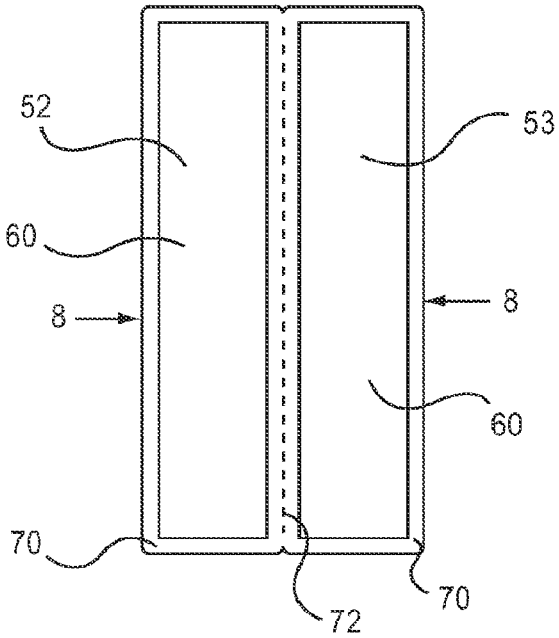
FIG. 6 is a plan view of a solid-fabric embodiment of two canopy segments.

FIG. 6 is a plan view of a solid-fabric embodiment of two canopy segments. In this embodiment, $2^{nd}$ canopy segment 52 and $3^{rd}$ canopy segment 53 are comprised of solid panels 60 which are covered on all sides by fabric 70. Stitching 72 between the segments provides a hinge which allows movement of the connected segments.

Figure 7:
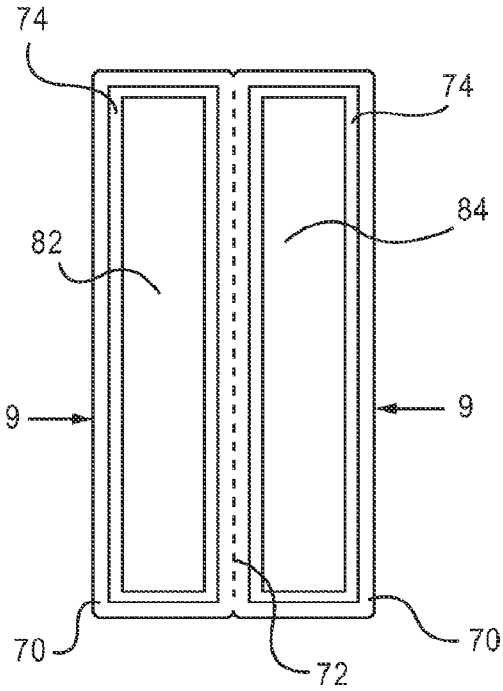
FIG. 7 is a plan view of a frame-fabric embodiment of two canopy segments.

FIG. 7 is a plan view of a frame-fabric embodiment of two canopy segments. In this embodiment, $2^{nd}$ canopy segment 82 and $3^{rd}$ canopy segment 84 are comprised of rectangular frames 74 which are covered on all sides by fabric 70. Stitching 72 between the segments provides a hinge which allows movement of the connected segments.

Figure 8:
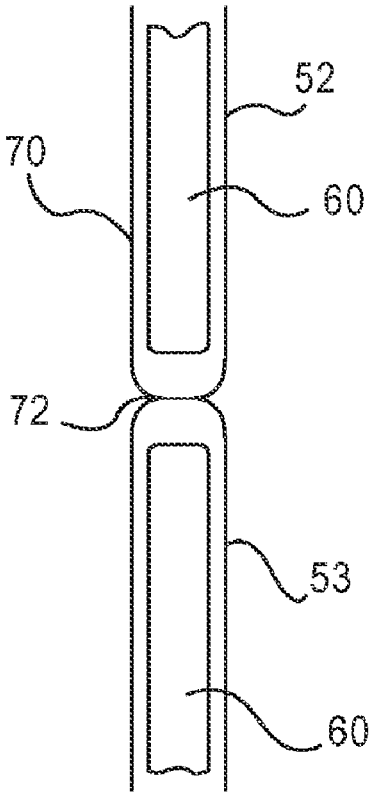
FIG. 8 is a cross-sectional view taken at arrows 8 of FIG. 6.

FIG. 8 is a cross-sectional view of canopy segments 52 and 53 taken at arrows 8 of FIG. 6. Visible in FIG. 8 are the solid panels 60 and the fabric 70 which encloses the panels. Also visible is the hinge 72 formed by stitching between the segments.

Figure 9:
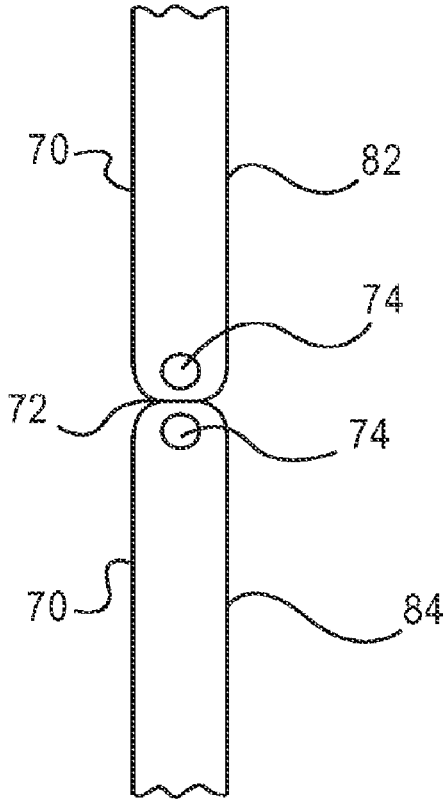
FIG. 9 is a cross-sectional view taken at arrows 9 of FIG. 7.

FIG. 9 is a cross-sectional view of canopy segments 82 and 84 taken at arrows 9 of FIG. 7. Visible in FIG. 9 are the frame 74 and the fabric 70 which encloses the panels. Also visible is the hinge 72 formed by stitching between the segments.

Figure 10:
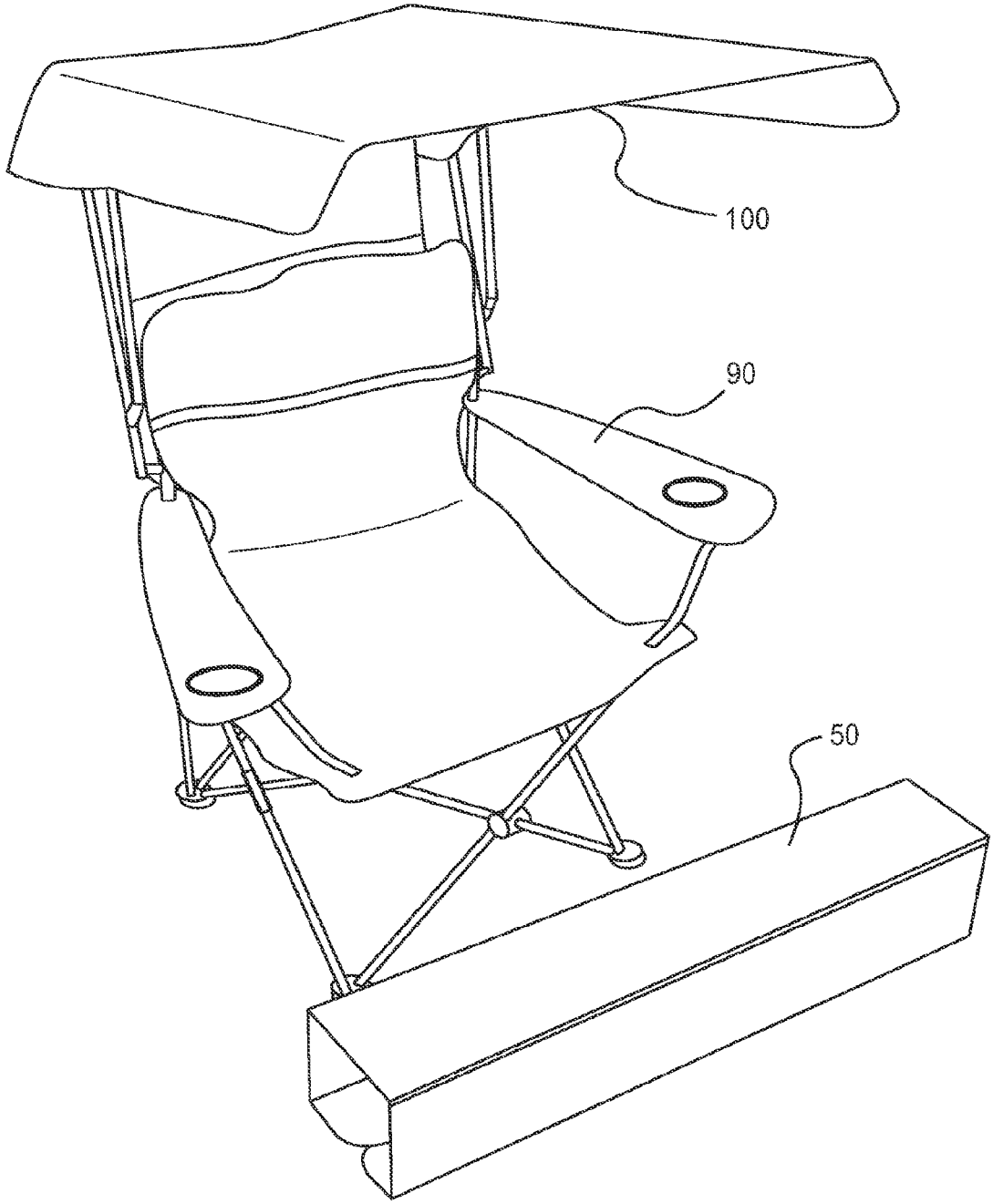
FIG. 10 is a perspective view of an embodiment canopy attached to a chair and of the canopy folded up for carrying.

FIG. 10 is a perspective view of an embodiment canopy attached to a chair and of the canopy folded up for carrying.

Visible in FIG. 10 is a chair 90, attached canopy in the overhead position 100, and canopy in the carrying position covered by the canopy 50.

Figure 11:
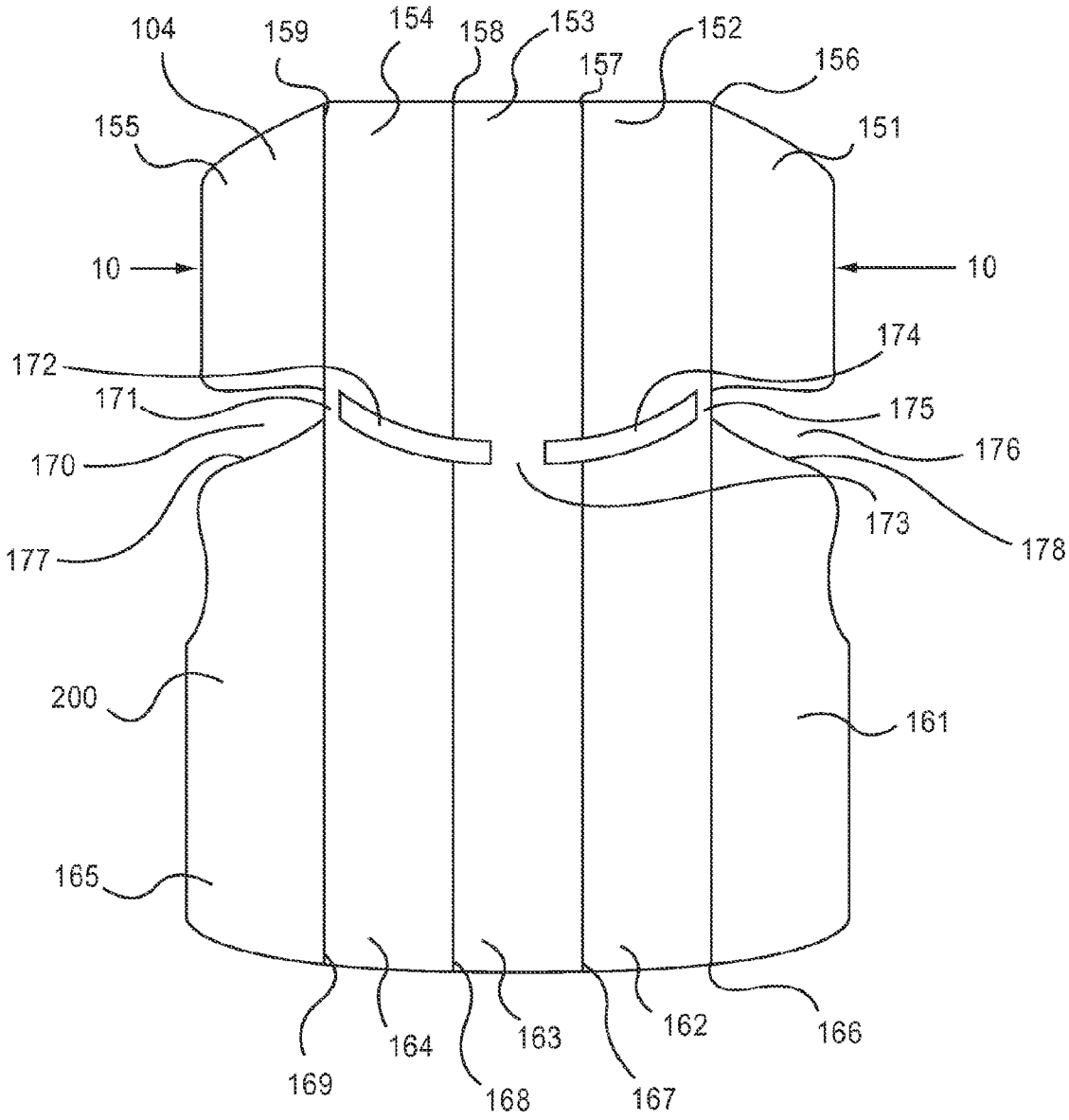
FIG. 11 is a plan view of the bottom side of a corrugated embodiment canopy.

FIG. 11 is a plan view of the bottom side 104 of a corrugated embodiment canopy 200. In this embodiment, forward segments 152, 153, 154, are attached by hinges to rearward segments 162, 163, and 164. Forward segments 151 and 155 are not attached to any rearward segments. Similarily, rearward segments 161 and 165 are not attached to any forward segments.

Forward segment 151 is attached by hinge 156 to forward segment 152, which is attached by hinge 157 to forward segment 153, which is attached by hinge 158 to forward segment 154, which is attached by hinge 159 to forward segment 155.

Rearward segment 161 is attached by hinge 166 to rearward segment 162, which is attached by hinge 167 to rearward segment 163, which is attached by hinge 168 to rearward segment 164, which is attached by hinge 169 to rearward segment 165.

Forward segment 154 is connected by hinge 171 to rearward segment 164. Forward segment 153 is connected by hinge 173 to rearward segment 163. Forward segment 152 is connected by hinge 175 to rearward segment 162.

Crescent-shaped openings 172 and 174 are cut between forward segments 154, 153, and 152 and rearward segments 164, 163, and 162, respectively. The forward edge 177 of rearward segment 165 is cut at an approximately 45° to hinge 169 forming a triangular space 170. The forward edge 178 of rearward segment 161 is cut at an approximately 45° to hinge 166 forming triangular space 176.

Slots 180, 182, 184, and 186 are cut in rearward segments 162, 163, and 164. These slots accommodate bolts attached to the support arms 140 and 40, respectively, (not shown in FIG. 12) and removably connect the canopy and frame. Washers on the bolts removably retain the canopy on the frame support arms.

Figure 12:
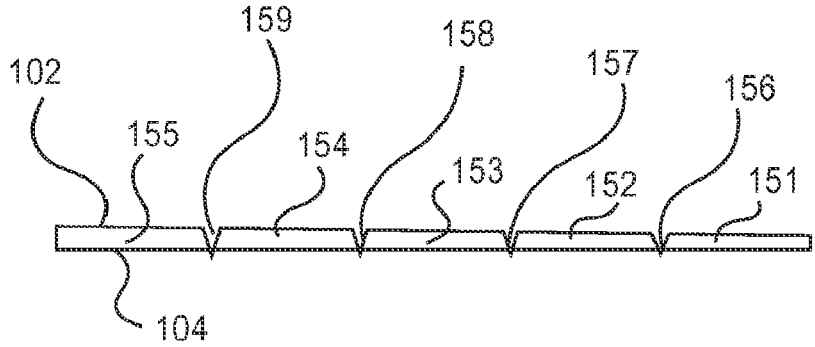
FIG. 12. is a cross-section view of a corrugated embodiment canopy taken at arrows 10 of FIG. 11.

FIG. 12. is a cross-section view of a corrugated embodiment canopy taken at arrows 10 of FIG. 11. Visible in FIG. 12 are the top 102 and bottom 104 of the canopy. In some embodiments the canopy is constructed of a single piece of corrugated material having flexible films on each side. The hinges 156, 157, and 159 are formed by cutting through the top surface 102, leaving the bottom surface 104 intact, thereby forming living hinges and delineating forward segments 151, 152, 153, 54, and 155, respectively.

Figure 13:
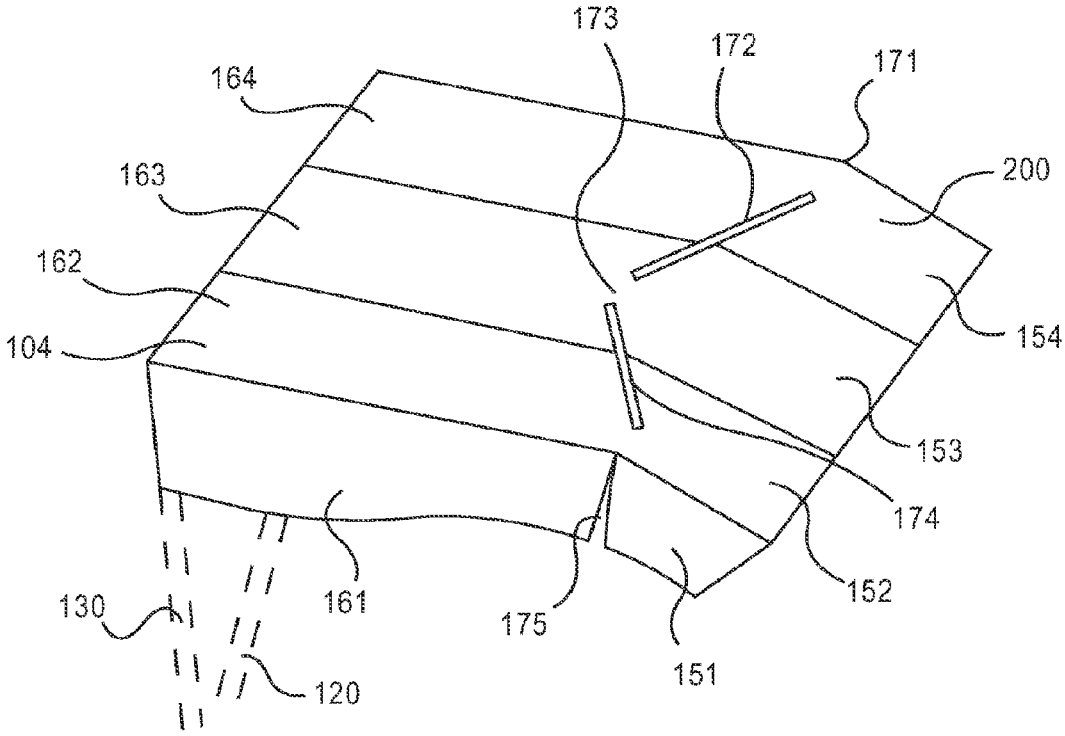
FIG. 13 is a perspective view of the corrugated embodiment canopy showing the droop of the forward segments.

FIG. 13 is a perspective view of the top 104 of a corrugated embodiment canopy 200 showing the droop of the forward segments. In FIG. 13, right forward bar 120 and right rear bar 140 are shown in dotted lines. This embodiment canopy while mounted has the rearward segments 162, 163, and 164 are in an approximately common plane while rearward segments 161 and 165 (not visible in FIG. 13) hang at approximately 90° to that common plane. Forward segments 152, 153, and 154 are in an approximately common plane while forward segments 151 and 155 (not visible in FIG. 13) hang at approximately 90° to that common plane. Forward segments 152, 153, and 154 droop downward due to gravity by hinges 175, 173, and 171, respectively. The droop of the forward segment eliminates the triangular spaces 175 between the forward segment 151 and rearward segment 161. The triangular space 170 between forward segment 155 and rearward segment 165 (not visible in FIG. 13) similarly is eliminated by the droop.

The droop of the forward segments has the desirable effect of countering the lifting effect of wind on the canopy while in the overhead position.

Figure 14:
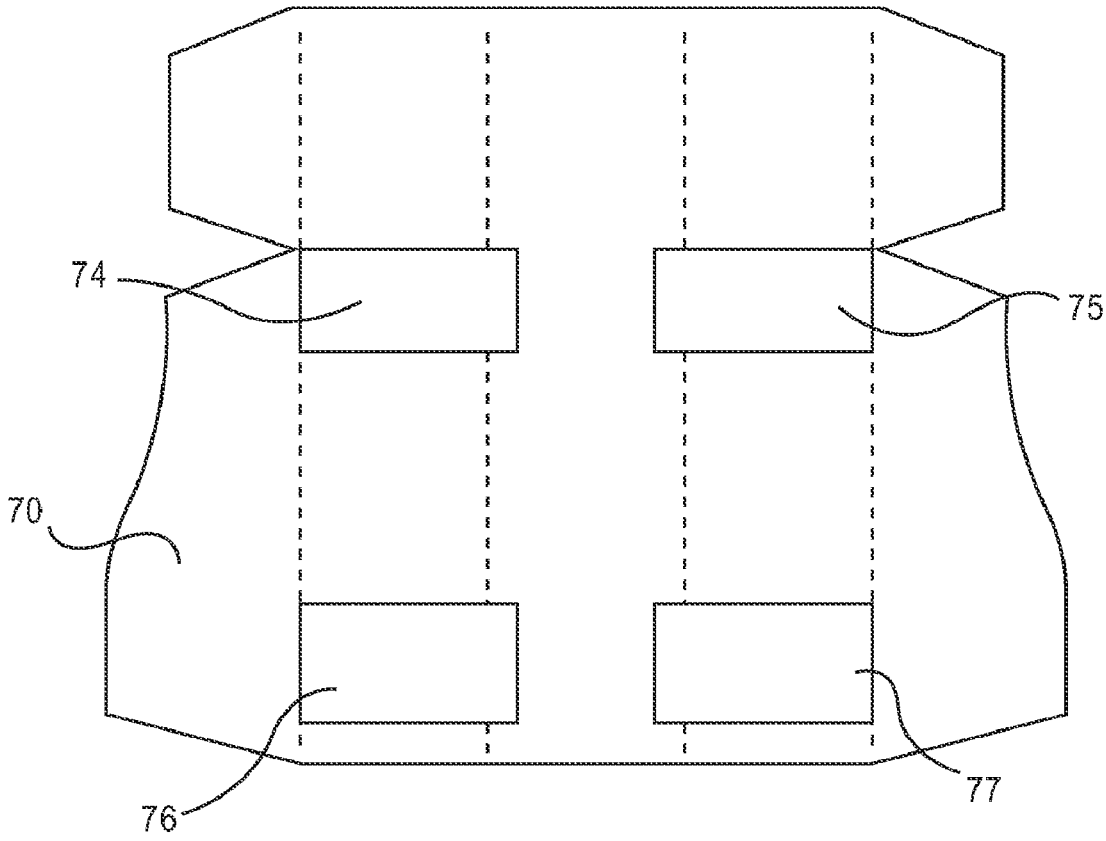
FIG. 14 is a bottom view of a fabric covered canopy.

FIG. 14 is a bottom view of a fabric covered canopy. Visible in FIG. 14 is the fabric 70 which covers both surfaces of the canopy. Also visible are sleeves 74, 76, 75 and 77. The sleeves are attached to the fabric by sewing along the short sides of the rectangular sleeves. The sleeves accommodate the support arms 140 and 40 (not shown in FIG. 12) and removably connect the canopy and frame. Lateral movement of the support arms within the sleeves allow the folding and unfolding of the chair and canopy as desired while retaining the canopy in place on the support arms.

Figure 15:
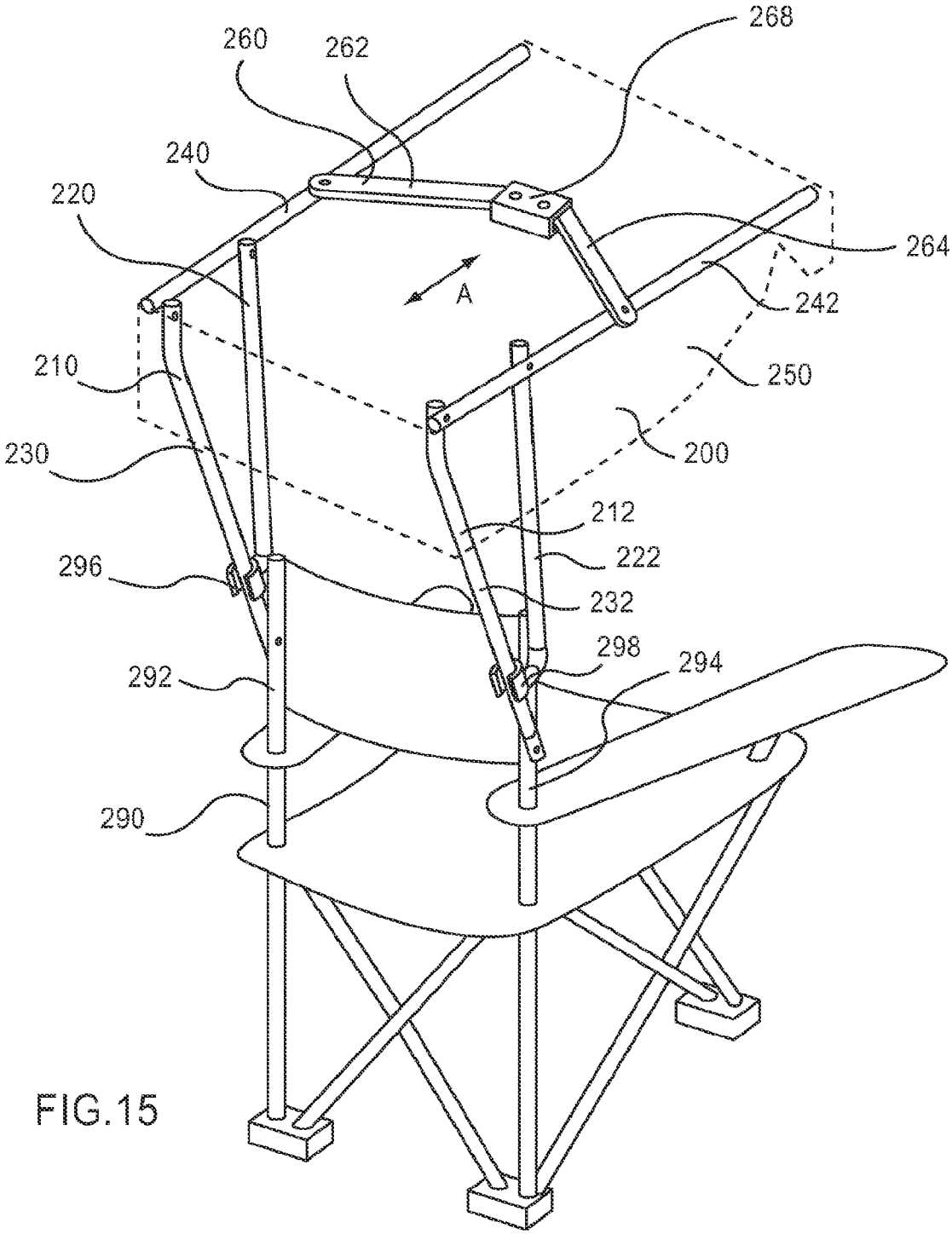
FIG. 15 is a perspective view of a canopy chair frame embodiment which supports a soft fabric canopy embodiment.

FIG. 15 is a perspective view of a canopy chair frame embodiment which supports a soft fabric canopy embodiment 200 in the overhead position. The soft fabric canopy embodiment 200 comprises flexible fabric with no frame incorporated in the fabric. The chair 290 is depicted in FIG. 15. Any conventional folding chair may be used in this embodiment. The left vertical chair back 292 and right vertical chair back 294 are shown. Components of the left frame 210 visible in FIG. 15 are the left forward bar 220, left rear bar 230, and the left support arm 240, which supports the canopy 250, shown in dashed lines. The left forward bar 220 is attached at one end to the left vertical chair back 292 and pivotally attached at the other end to the left support arm 240. The left rear bar 230 is pivotally attached to the left vertical chair back 292 at one end, pivotally attached to one end of the left support arm 240 at the other end, and is reversibly attached by clamp 296 to the forward bar 220. Components of the right frame 212 have elements in structures similar to that of the left frame 210. Visible in FIG. 15 are the right forward bar 222, clamp 298, right rear bar 232, and the right support arm 242, which supports the canopy 250.

A tensioner 260 extends between the left support arm 240 and right support arm 242. The tensioner 260 comprises a left arm 262 pivotly connected on one end to the left support arm 240 and pivotally connected at the other end to a U-shaped bracket 268 and a right arm 264 pivotally connected at one end to the right support arm 242 and at the other end to the U-shaped bracket 268. The bracket 268 can be manually moved reciprocally back and forth in the directions shown by arrow A. When the bracket 268 is moved rearwardly in the direction of the forward bar 220 the tension between the support arms is relieved and the chair can be collapsed. When the bracket 268 is moved in the direction of the front of the canopy the distance between the support arms is increased and the tension on the canopy is increased. This maintains the configuration of the soft fabric canopy approximately in a flat plane and prevents the formation of wrinkles in the soft fabric canopy.

Figure 16:
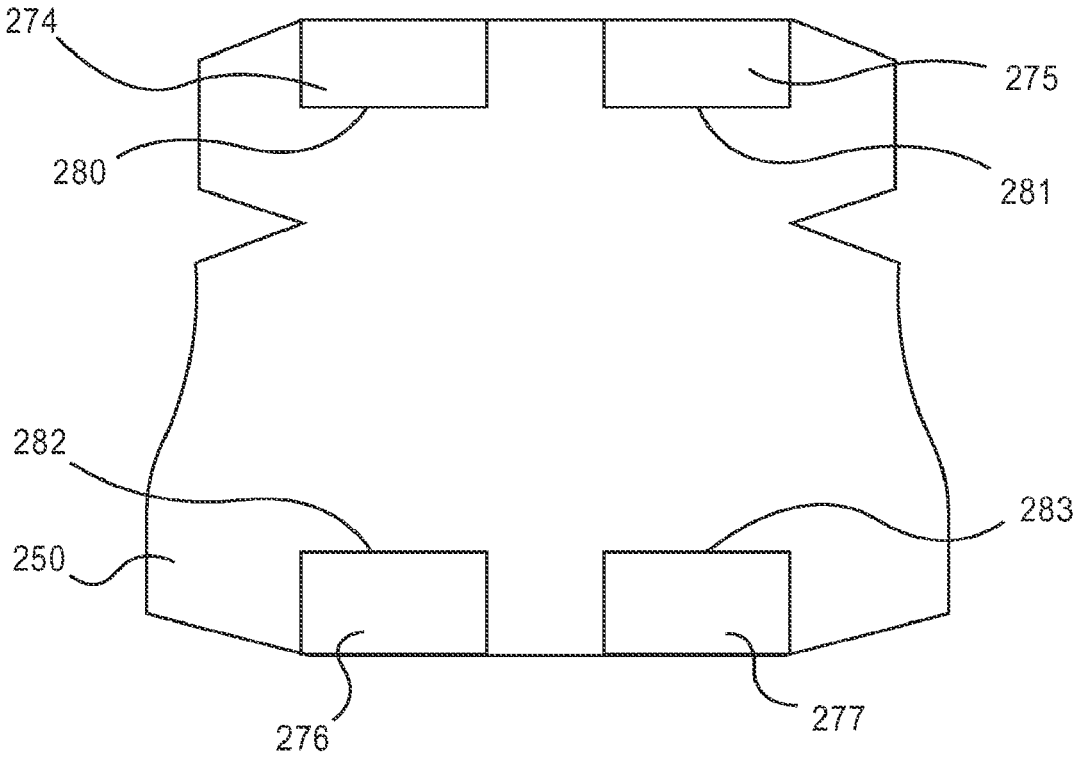
FIG. 16 is a plan view of the underside of a soft fabric canopy embodiment.

FIG. 16 is a plan view of the underside of a soft fabric canopy embodiment 250. Visible in FIG. 16 are pockets 274, 275, 276, and 277. The pocket are formed of fabric sewed to the soft fabric embodiment 250 on three sides. Sides 280, 281, 282, and 283 are not attached to the soft fabric canopy. The pockets so formed accommodate the ends of the support arms in the frames. The unattached sides of the pockets allow the movement of the support arms when the canopy chair is folded up in the carrying position. Other methods of attaching the pockets, such as riveting, fusing, and gluing, can be used to attach the pockets to the canopy.

Figure 17:
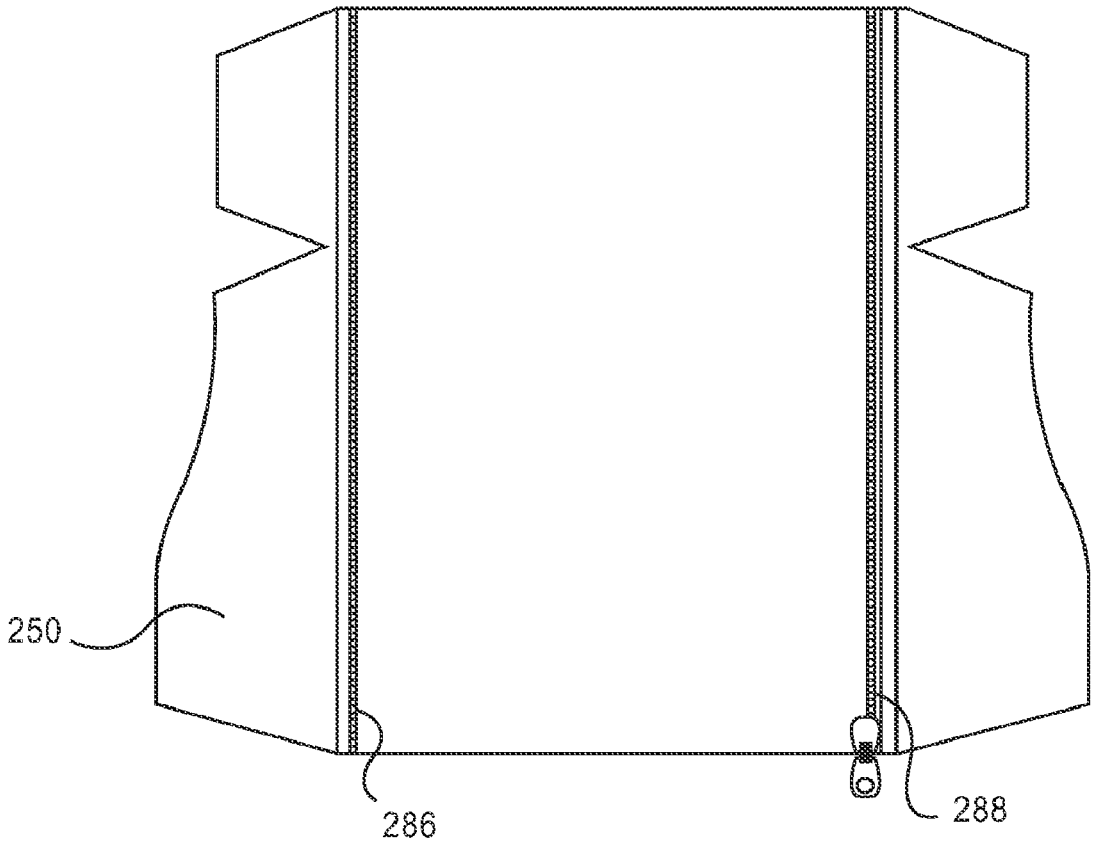
FIG. 17 is a plan view of the top side of a soft fabric canopy embodiment.

FIG. 17 is a plan view of the top side of a soft fabric canopy embodiment 250. Visible in FIG. 17 is the left zipper 286 and right zipper 288 which extend along the length of the back of the soft fabric canopy embodiment 250. The zipper components 286 and 288 interact and secure the soft fabric canopy embodiment around the chair and frame components when the canopy and chair is folded up in the carrying position.

Figure 18:
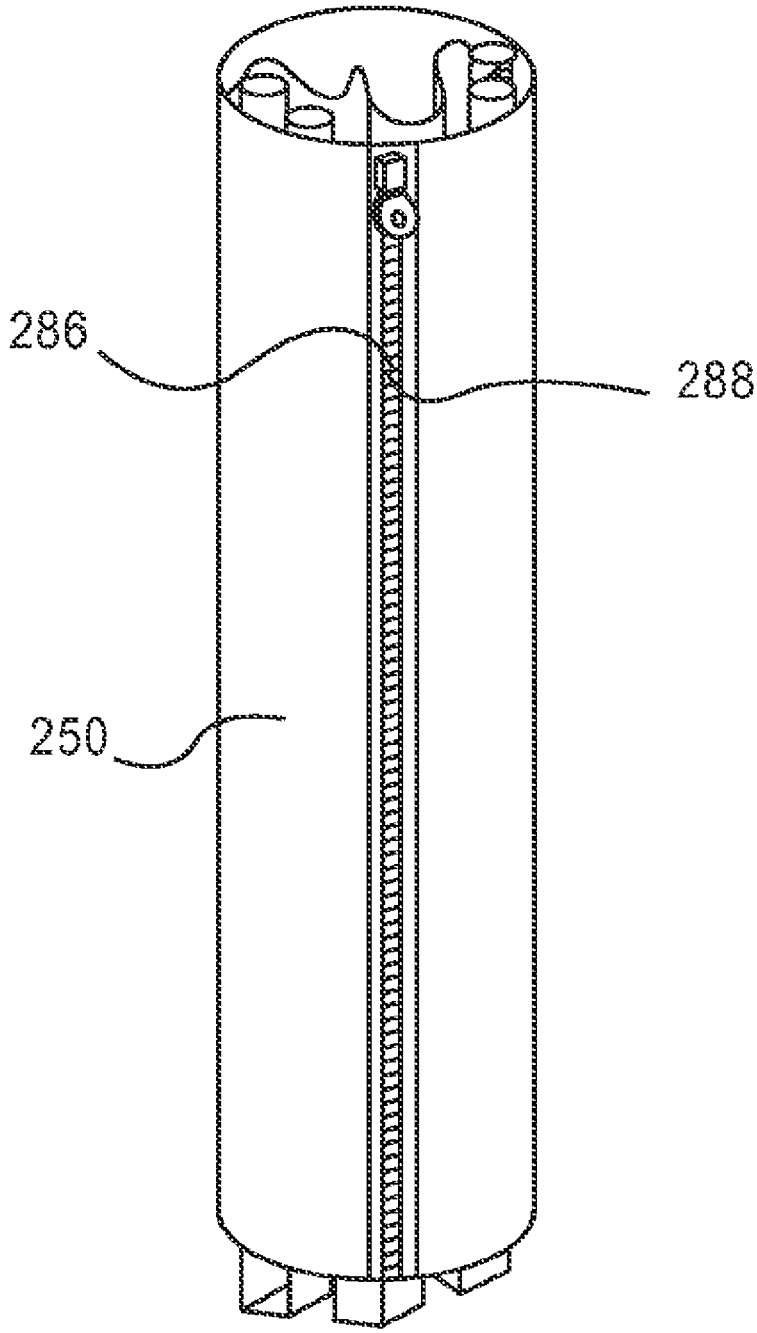
FIG. 18 is a perspective view of a soft fabric canopy chair embodiment in the carrying position.

FIG. 18 is a perspective view of a soft fabric canopy chair embodiment in the carrying position. Visible in FIG. 18 is the soft fabric embodiment canopy 250 which engulfs the chair and frame components and the left zipper 286 and right zipper 288 which reversibly secure the canopy about the folded chair and frame components. It is not necessary to remove the soft fabric canopy from the frame when the chair and canopy are collapsed and the canopy is secured around the chair and frame.

Figure 19A:
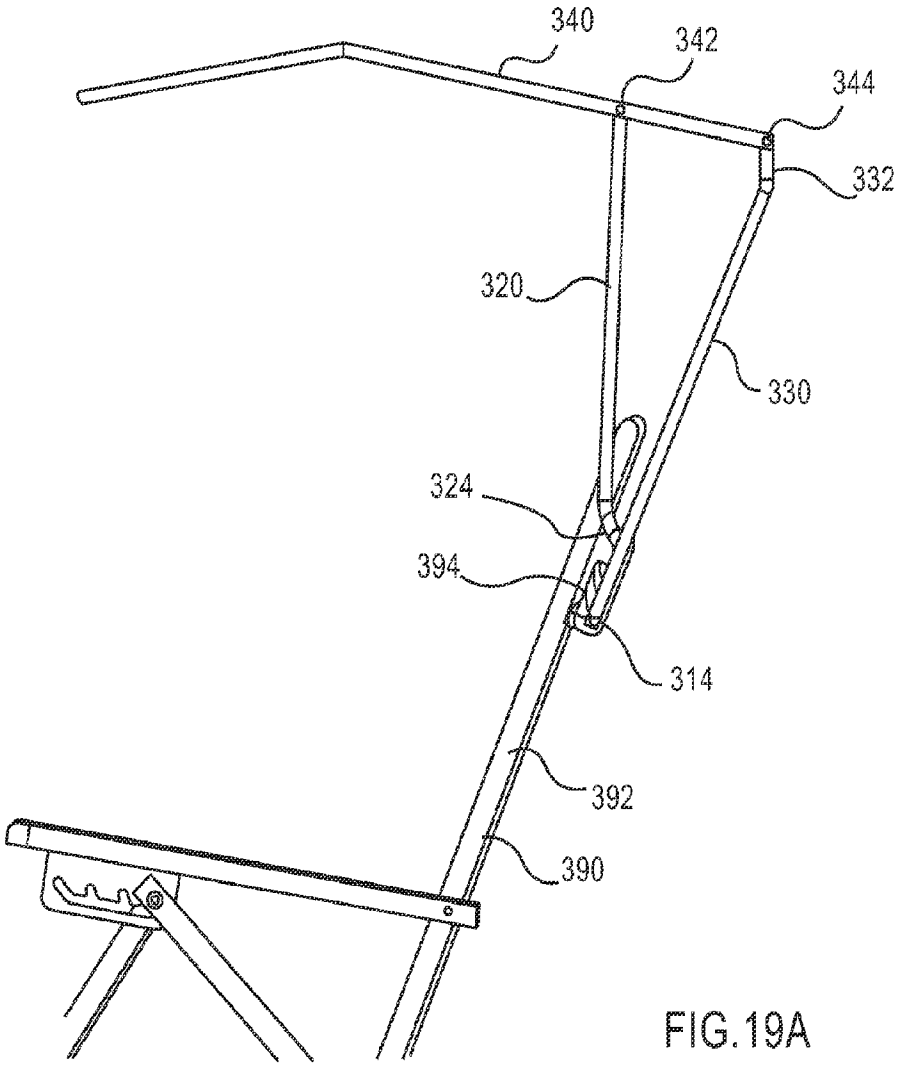
FIG. 19A is a side view of a bracket chair back embodiment frame in the above the chair position.

FIG. 19A is a side view of a bracket chair back embodiment frame in the above the chair position. Visible in FIG. 19A is the chair 390 and left chair vertical support 392. A bracket 394 is attached to the left chair vertical support 392. The left rear bar 330 is pivotally attached by pivot 314 to the bracket 394. An off set portion 332 of the left rear bar 330 is attached by a pivot 344 to one end of the left upper support bar 340. A offset portion 324 of a left forward bar 320 is pivotally attached to bracket 394 above the attachment of the left rear bar. The left forward bar 320 is attached by a pivot 342 to the left support bar 340. A similar frame structure is on the right side of the chair.

Figure 19B:
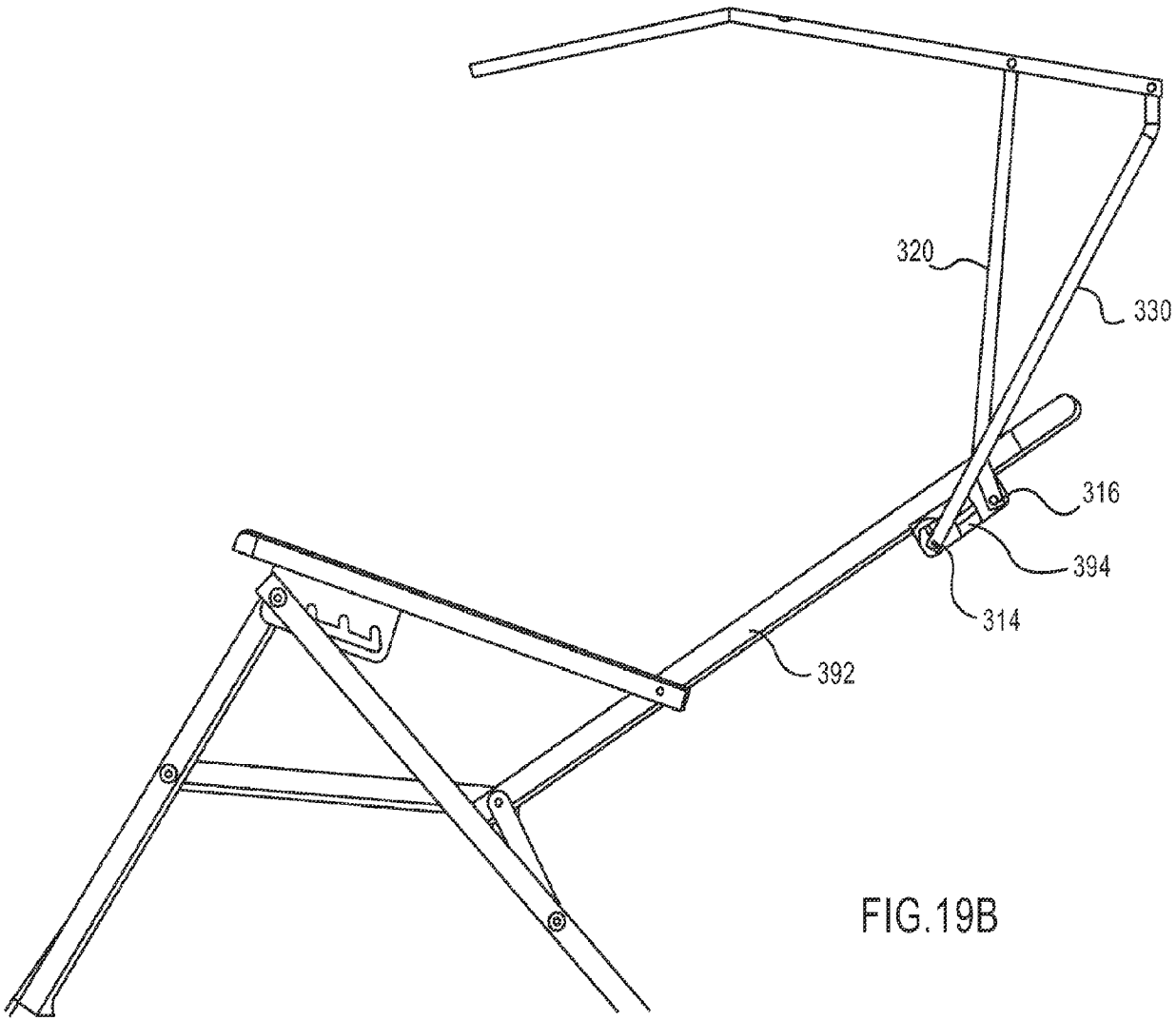
FIG. 19B is a side view of a bracket chair back embodiment frame in the reclining chair position.

FIG. 19B is a side view of a bracket chair back embodiment frame in the reclining chair position. Although the chair is in a reclining position, the frame and associated canopy is in the overhead position, providing maximum protection for the user from the sun or rain. The elements of FIG. 19B are the same as in FIG. 19A except the left chair vertical support 392 is in a reclining position and the canopy frame is inclined forward in order to keep the canopy in the overhead position and provide desired shade to the user of the chair. Additional detail concerning the pivot connection 316 of the left forward bar 320 and the pivot connection 314 of the left rear bar 330 to bracket 394 is shown in FIG. 19B. Note that left forward bar 320 and left rear bar 330 are spaced apart so they both can be moved freely adjacent to each other and movement of one does not interfere with movement of the other.

Figure 19C:
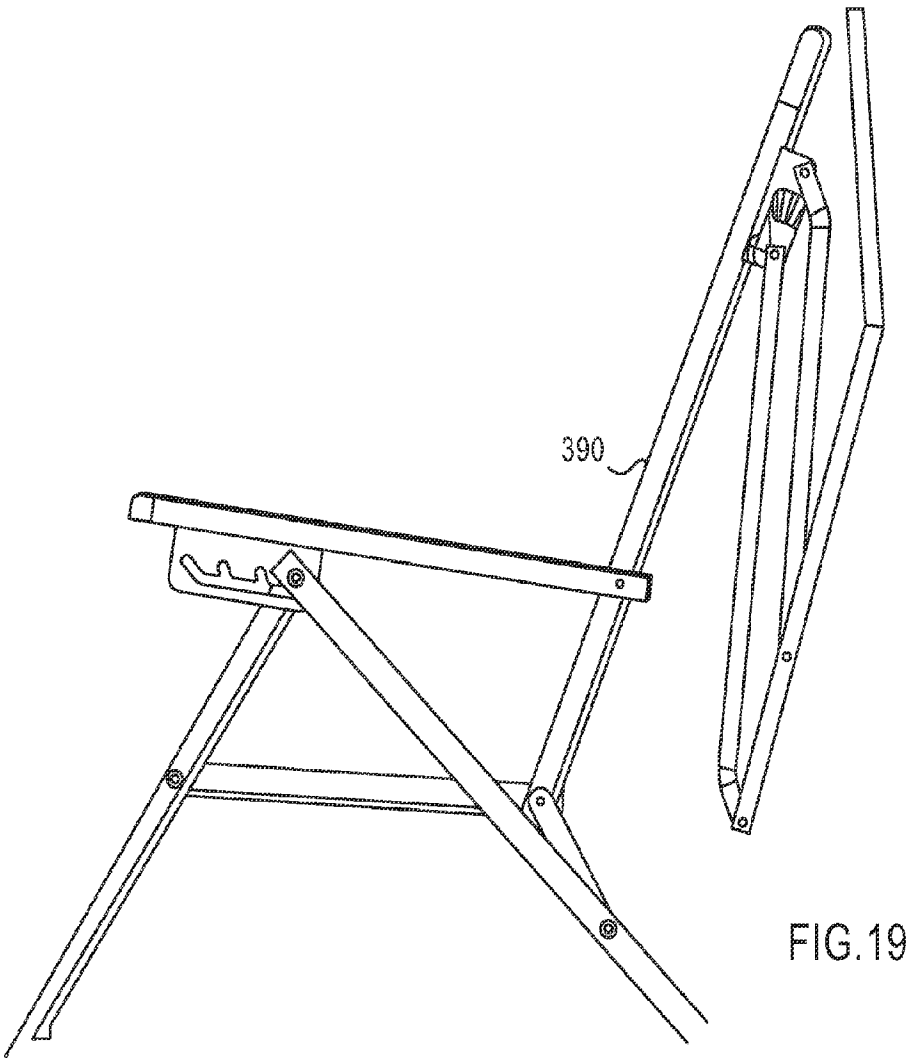
FIG. 19C is a side view of a bracket chair back embodiment frame in the behind the chair position.

FIG. 19C is a side view of a bracket chair back embodiment frame in the behind the chair position. The elements of FIG. 19C are the same as in FIG. 19A and FIG. 19B except the canopy frame has been moved to the behind the chair position.

Figure 20A:
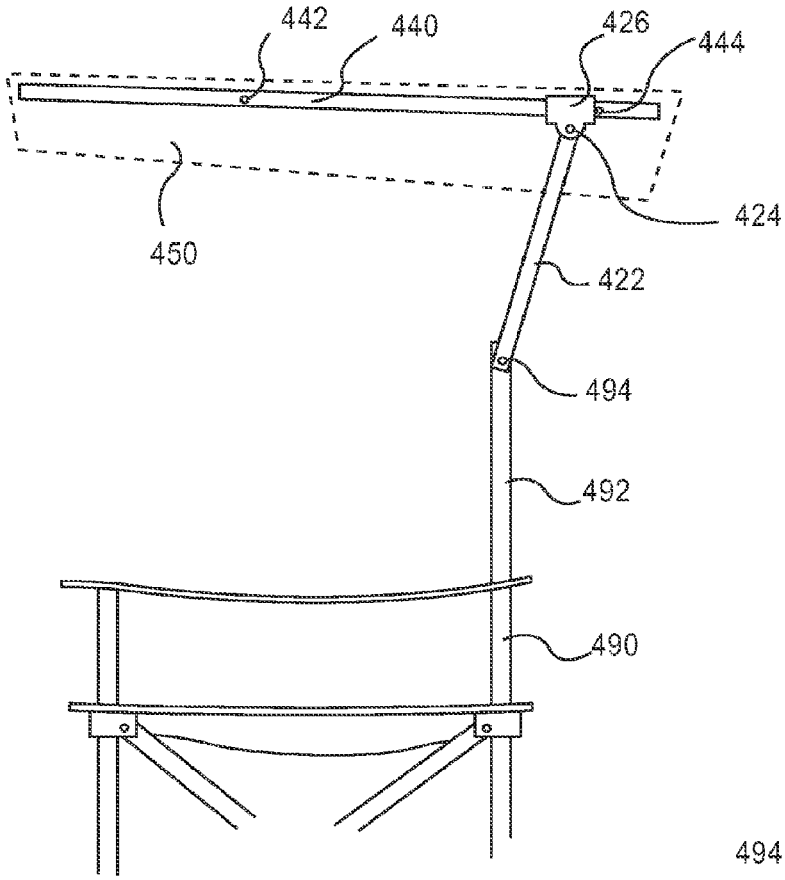
FIG. 20A is a side view of a hinged chair back embodiment frame in the overhead position.

FIG. 20A is a side view of a hinged chair back embodiment frame 490 in the overhead position. In this embodiment the left chair vertical support 492 is hinged at the upper end by a pivoting connector 494 to the lower end of the left canopy arm 422. The other end of arm 422 is pivotally attached by pivot 424 to cylindrical collar 426. The left support arm 440 is supported by and may slide within the cylindrical collar 426. Movement of the left support arm 440 in the cylindrical collar 426 is constrained near one end by lower pin 444 and intermediately along the length of the left support arm 440 by upper pin 442. The left support arm 440 supports the canopy 450. A corresponding right frame is attached at the right side of the chair.

Figure 20B:
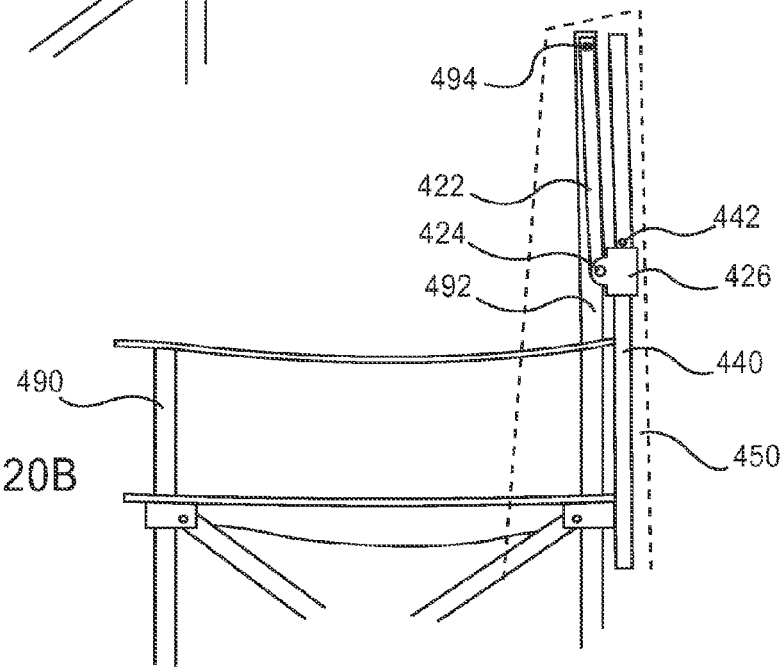
FIG. 20B is a side view of a hinged chair back embodiment frame in the behind the chair position.

FIG. 20B is a side view of a hinged chair back embodiment frame 490 in the behind the chair position. Visible in FIG. 20B is the left canopy support arm 422 which has been rotated at pivot 494 to a position against the left chair vertical support thereby bringing the left support arm 440 and the canopy 450 to the behind the chair position. The cylindrical collar 426 has pivoted by pivot 424 against the left canopy support arm 422. Movement of the left support arm 440 within the cylindrical collar 426 has been constrained by the upper pin 442. The result of this movement is to place the canopy 450 in the behind the chair position.

Figure 21A:
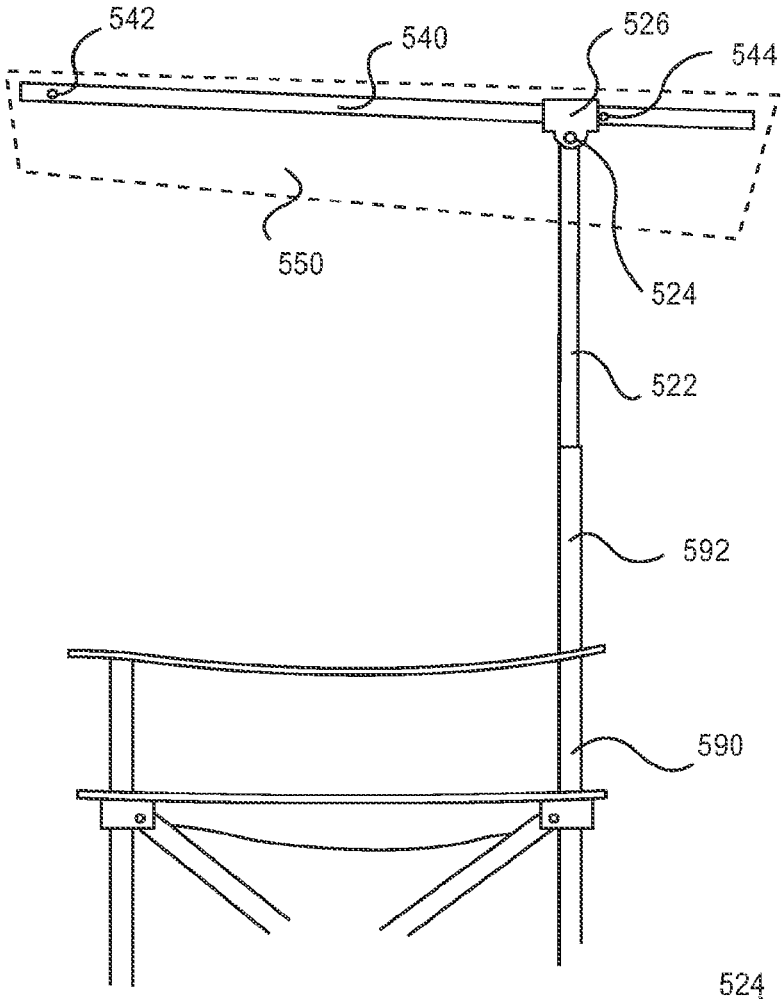
FIG. 21A is a side view of a telescope chair back embodiment frame in the overhead position.

FIG. 21A is a side view of a telescope chair back embodiment frame 590 in the overhead position. In this embodiment the left tubular chair vertical support 592 receives in telescope-like fashion and one end of left connector arm 522. Movement of left connector arm 522 in the left chair vertical support 592 is constrained by friction. The other end of left connector arm 522 is pivotally attached by pivot 524 to a cylindrical collar 526. The left support arm 540 is supported by and may slide within the cylindrical collar 526. Movement of the left support arm 540 in the cylindrical collar 526 is constrained at one end by lower pin 544 and intermediately along the length of the left support arm 540 by upper pin 542. The left support arm 540 supports the canopy 550. A corresponding right frame is attached at the right side of the chair.

Figure 21B:
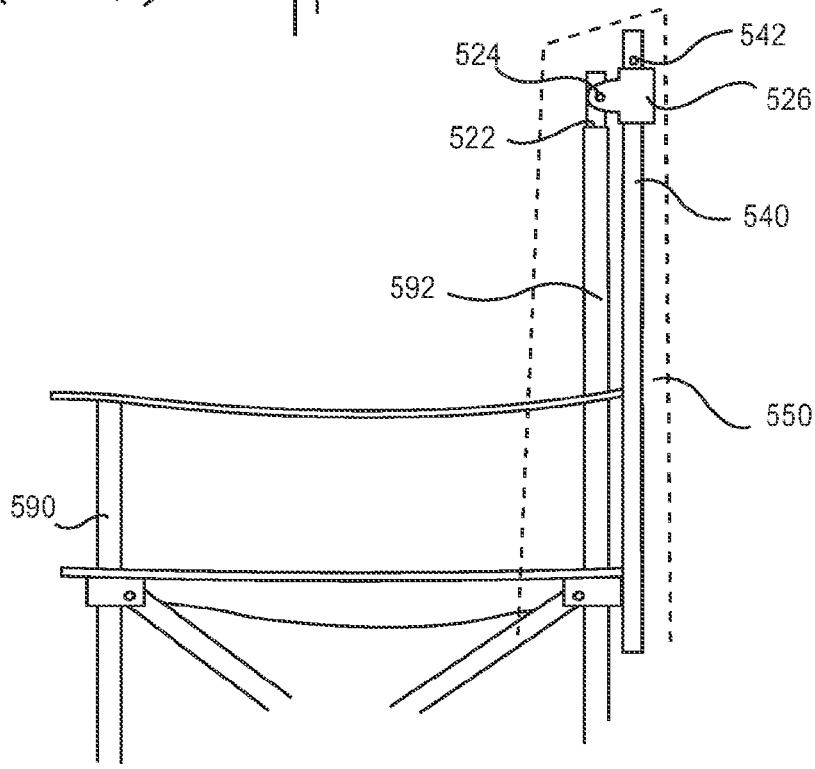
FIG. 21B is a side view of a telescope chair back embodiment frame in the behind the chair position.

FIG. 21B is a side view of a telescope chair back embodiment frame 590 in the behind the chair position. Visible in FIG. 20B is the left chair vertical support 592 which receives left connector arm 522. Left connector arm 522 has been pushed into the left chair vertical support 592. The cylindrical collar 526 has pivoted at pivot 524. The left canopy support arm 540 has slid downward in the cylindrical collar 526 and its movement has been constrained by the upper pin 442. The result of this movement is to place the canopy 550 in the behind the chair position.

A number of embodiment frames and canopies have been disclosed. It is anticipated that any canopy can be used with any frame.

The corrugated embodiment canopy may be constructed by any suitable light non-flexible material, such as corrugated plastic, corrugated paper, or of solid material such as wood or plastic. The hinges of the corrugated canopy segments may be any suitable hinges, such as living hinges as disclosed above or of strips of flexible material such as fabric or plastic which is attached to the edges of the segments. The hinges between the forward and rearward segments may be hinges as above or may simply be regions of the material of the canopy which is rendered flexible by virtue of their width.

The frame elements are manufactured of any suitable strong, resilient, lightweight, inexpensive material. Suitable materials include plastic, aluminum, and wood. Tubular materials are suitable. Suitable materials for the pivot element include plastic, aluminum, steel.

The solid canopy segment panel materials are any suitable strong, lightweight, relatively inflexible materials. Suitable materials include corrugated plastic, corrugated paper, foamed plastic, and fiberglass.

The frame-fabric embodiment canopy segment frames are manufactured by the same materials as the frame elements.

The canopy fabric material is any suitable strong, weather resistant, flexible material. Suitable fabrics include nylon, cotton, rayon, fiberglass fabrics and flexible plastic sheets.

The sleeves attached to the fabric material may be of the same fabric used to cover the canopy or may be made of sheets of plastic material.

An embodiment canopy in the overhead position serves to protect the chair occupant from the overhead sun. On cloudy days a chair with an embodiment canopy may be used as a conventional chair simply by moving the canopy to the behind the chair position without disassembly of the canopy or canopy support.

Although embodiments of the canopy in this disclosure have been illustrated using folding chairs only, other embodiments may be used with non-folding chairs.

In addition, other embodiments are used with virtually any other outdoor furniture. In particular, embodiments are used with hammocks, with a picnic table, or with a stool or chaise lounge. In these embodiments the canopy is supported by driving the left and right frames into the ground or by attaching the frames to appropriate structures.

While a number of exemplary aspects and embodiments have been discussed above, those of skill in the art will recognize certain modifications, permutations, additions and sub combinations thereof. It is therefore intended that the following appended claims and claims hereafter introduced are interpreted to include all such modifications, permutations, additions and sub-combinations as are within their true spirit and scope.

We claim:

1. Outdoor furniture frame and canopy, comprising:

a canopy and a frame, the frame having a first support arm and a second support arm, the frame supporting the canopy, the frame capable of orientation in an overhead position, a behind the furniture position, and any intermediate position, the frame having a forward bar, a rear bar, a support arm, and a tensioner, the forward bar attached to the outdoor furniture at one end and pivotally attached to the first support arm at the other end, the rear bar pivotally attached to the outdoor furniture at one end and to the first support arm at the other end, the rear bar attached by a reversible clamp to the forward bar, the tensioner fastened to the first support arm and to the second support arm, the first support arm capable of supporting the canopy.

2. The frame of claim 1 wherein the tensioner comprises two arms, each arm pivotally connected to a U-shaped bracket at one end, and pivotally connected to the first support arm or the second support arm at the other end.

3. Outdoor furniture frame and canopy comprising:

a canopy and a frame, the frame having at least two support arms, the frame supporting the canopy, the frame capable of orientation in an overhead position, a behind the furniture position, and any intermediate position, the canopy having approximately rectangular external segments and approximately rectangular internal segments, the segments hinged together along the long sides, and connectors for attaching the canopy to a frame, the canopy capable of enclosing a collapsed frame and collapsed item of outdoor furniture when folded in the carrying position.

4. The canopy of claim 3 wherein the external segments are approximately perpendicular to the plane of the internal segments when the canopy is in the overhead position.

5. The canopy of claim 3 wherein the segments are constructed of rigid material covered by fabric.

6. The canopy of claim 5 wherein the rigid material is constructed of plastic, paper, foamed plastic, or fiberglass.

7. The canopy of claim 3 wherein the segments are constructed of fabric covered frames.

8. An apparatus, comprising:

a chair having a collapsed configuration and an expanded configuration; and a canopy coupled to the chair and having a range of motion between a collapsed configuration and an expanded configuration, the chair being disposed within a container defined by the canopy when the canopy is in its collapsed configuration, the canopy includes a canopy frame and a canopy membrane coupled to the canopy frame, the canopy frame includes a first elongated member, a second elongated member and a third elongated member, the first elongated member being coupled to the third elongated member at a first location of the third elongated member, the second elongated member being coupled to the third elongated member at a second location of the third elongated member different from the first location of the third elongated member, the first elongated member being configured to couple to the chair at a first location of the chair, the second elongated member being configured to couple to the chair at a second location of the chair different from the first location of the chair.

9. The apparatus of claim 8, wherein:

the chair includes a back member and a seat member; and the canopy has an outer side and an inner side, the canopy having a first position and a second position different from the first position when in the expanded configuration, at least a portion of the inner side of the canopy is disposed between at least a portion of the outer side of the canopy and at least a portion of the back member when the canopy is in the first position, at least a portion of the inner side is disposed between at least a portion of the outer side and at least a portion of the seat member when the canopy is in the second position.

10. The apparatus of claim 8, wherein:

the chair includes a back member and a seat member; and the canopy membrane of the canopy having a first position and a second position different from the first position, the canopy membrane being substantially parallel to the back member when the canopy is in the first position, the canopy membrane being substantially parallel to the seat member when the canopy is in the second position.

11. An apparatus, comprising:

a chair; and a canopy having a canopy frame coupled to the chair, the canopy frame including an upper first side elongated member and an upper second side elongated member, the canopy frame having a first configuration and a second configuration different than the first configuration, the upper first side elongated member and the upper second side elongated member being separated by a first distance when the canopy frame is in the first configuration, the upper first side elongated member and the upper second side elongated member being separated by a second distance different from the first distance when the canopy frame is in the second configuration, the canopy including a canopy membrane having a front end portion and a back end portion opposite the front end portion, the front end portion including a pocket portion having a width at least a third of the distance between the upper first side elongated member and the upper second side elongated member when the canopy frame is in the first configuration, a portion of the upper first side elongated member being slidably disposed within the pocket portion.

12. The apparatus of claim 11, wherein:

the upper first side elongated member is substantially parallel to the upper second side elongated member in the first configuration and the second configuration.

13. The apparatus of claim 11, wherein:

the canopy includes a canopy membrane having a front end portion and a back end portion opposite the front end portion, the back end portion including a sleeve portion having a width at least a third of the distance between the upper first side elongated member and the upper second side elongated member when the canopy frame is in the first configuration, the upper first side elongated member being slidably coupled to the sleeve.

14. The apparatus of claim 11, wherein:

the upper first side elongated member moves laterally from a first position associated with the first configuration of the canopy frame to a second position associated with the second configuration of the canopy frame when the canopy frame moves from the first configuration to the second configuration.

15. The apparatus of claim 11, wherein:

the canopy includes a canopy membrane defining a container configured to envelope the chair when the canopy frame is in the second configuration.

16. An apparatus, comprising:

a chair; and a canopy having a canopy frame coupled to the chair, the canopy frame including an upper first side elongated member and an upper second side elongated member, the canopy frame having a first configuration and a second configuration different than the first configuration, the upper first side elongated member and the upper second side elongated member being separated by a first distance when the canopy frame is in the first configuration, the upper first side elongated member and the upper second side elongated member being separated by a second distance different from the first distance when the canopy frame is in the second configuration, the canopy includes a canopy membrane having a front end portion and a back end portion opposite the front end portion, the back end portion including a sleeve portion, the upper first side elongated member being slidably coupled to the sleeve.

17. The apparatus of claim 16, wherein:

the upper first side elongated member is substantially parallel to the upper second side elongated member in the first configuration and the second configuration.

18. The apparatus of claim 16, wherein:

the canopy includes a canopy membrane having a front end portion and a back end portion opposite the front end portion, the front end portion including a pocket portion having a width at least a third of the distance between the upper first side elongated member and the upper second side elongated member when the canopy frame is in the first configuration, a portion of the upper first side elongated member being slidably disposed within the pocket portion.

19. The apparatus of claim 16, wherein:

the sleeve has a width at least a third of the distance between the upper first side elongated member and the upper second side elongated member when the canopy frame is in the first configuration.

20. The apparatus of claim 16, wherein:

the upper first side elongated member moves laterally from a first position associated with the first configuration of the canopy frame to a second position associated with the second configuration of the canopy frame when the canopy frame moves from the first configuration to the second configuration.

21. The apparatus of claim 16, wherein:

the canopy includes a canopy membrane defining a container configured to envelope the chair when the canopy frame is in the second configuration.

22. An apparatus, comprising:

a chair having a back member and a seat member;

a canopy frame coupled to the chair, the canopy frame having a first position and a second position different from the first position; and a canopy membrane coupled to the canopy frame, the canopy membrane having an expanded configuration and a collapsed configuration, at least a portion of the canopy membrane being substantially parallel to the back member when the canopy membrane is in the expanded configuration and the canopy frame is in the first position, at least a portion of the canopy membrane being substantially parallel to the seat member when the canopy membrane is in the expanded configuration and the canopy frame is in the second position, the canopy membrane defining a container configured to envelope the chair when the canopy membrane is in the collapsed configuration, the canopy frame includes a first elongated member and a second elongated member, the first elongated member being coupled to the chair at a first location of the chair, the second elongated member being coupled to the chair at a second location of the chair different from the first location of the chair, the second elongated member including a clamp releasably coupled to the first elongated member such that at least a portion of the second elongated member is disposed above at least a portion of the chair.

23. The apparatus of claim 22, wherein:

the chair has an expanded configuration and a collapsed configuration; and at least a central portion of the container being configured to envelope the chair when the canopy membrane is in the collapsed configuration and the chair is in the collapsed configuration.

24. An apparatus, comprising:

a chair having a back member and a seat member;

a canopy frame coupled to the chair, the canopy frame having a first position and a second position different from the first position: and a canopy membrane coupled to the canopy frame, the canopy membrane having an expanded configuration and a collapsed configuration, at least a portion of the canopy membrane being substantially parallel to the back member when the canopy membrane is in the expanded configuration and the canopy frame is in the first position, at least a portion of the canopy membrane being substantially parallel to the seat member when the canopy membrane is in the expanded configuration and the canopy frame is in the second position, the canopy membrane defining a container configured to envelope the chair when the canopy membrane is in the collapsed configuration, the canopy frame includes a first elongated member, a second elongated member and a third elongated member, the first elongated member being coupled to the third elongated member at a first location of the third elongated member, the second elongated member being coupled to the third elongated member at a second location of the third elongated member different from the first location of the third elongated member, the first elongated member being configured to couple to the chair at a first location of the chair, the second elongated member being configured to couple to the chair at a second location of the chair different from the first location of the chair.

25. An apparatus, comprising:

a canopy frame including a first elongated member, a second elongated member and a third elongated member, the first elongated member being coupled to the third elongated member at a first location of the third elongated member, the second elongated member being coupled to the third elongated member at a second location of the third elongated member different from the first location of the third elongated member, the first elongated member being configured to couple to a chair at a first location of the chair, the second elongated member being configured to couple to the chair at a second location of the chair different from the first location of the chair, the second elongated member including a clamp configured to releasably connect to the first elongated member such that at least a portion of the second elongated member is disposed above at least a portion of the chair.

26. The apparatus of claim 25, further comprising:

the chair; and the first elongated member being coupled to the chair at the first location of the chair, the second elongated member being coupled to the chair at the second location of the chair.

27. The apparatus of claim 25, wherein:

the canopy frame includes a fourth elongated member, a fifth elongated member and a sixth elongated member, the fourth elongated member being coupled to the sixth elongated member at a first location of the sixth elongated member, the fifth elongated member being coupled to the sixth elongated member at a second location of the sixth elongated member different from the first location of the sixth elongated member, the fourth elongated member being configured to couple to the chair at a third location of the chair different from the first location of the chair and the second location of the chair, the fifth elongated member being configured to couple to the chair at a fourth location of the chair different from the first location of the chair, the second location of the chair and the third location of the chair.

28. The apparatus of claim 25, wherein:

the canopy frame includes a fourth elongated member, a fifth elongated member and a sixth elongated member, the fourth elongated member being coupled to the sixth elongated member at a first location of the sixth elongated member, the fifth elongated member being coupled to the sixth elongated member at a second location of the sixth elongated member different from the first location of the sixth elongated member, the fourth elongated member being configured to couple to the chair at a third location of the chair different from the first location of the chair and the second location of the chair, the fifth elongated member being configured to couple to the chair at a fourth location of the chair different from the first location of the chair, the second location of the chair and the third location of the chair, the canopy frame includes a seventh elongated member having an expanded configuration and a collapsed configuration, the third elongated member being coupled to the seventh elongated member, the sixth elongated member being coupled to the seventh elongated member.

* * * * *